US012564225B2

(12) United States Patent
Chong et al.

(10) Patent No.: US 12,564,225 B2
(45) Date of Patent: Mar. 3, 2026

(54) MOISTURE MANAGEMENT BRA

(71) Applicant: MODIBODI AUSTRALIA PTY LTD, Rozelle (AU)

(72) Inventors: Kristy Chong, Rozelle (AU); Alice Warner, Rozelle (AU)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 96 days.

(21) Appl. No.: 18/551,411

(22) PCT Filed: Mar. 23, 2022

(86) PCT No.: PCT/AU2022/050264
§ 371 (c)(1),
(2) Date: Sep. 20, 2023

(87) PCT Pub. No.: WO2022/198272
PCT Pub. Date: Sep. 29, 2022

(65) Prior Publication Data

US 2024/0172813 A1 May 30, 2024

(30) Foreign Application Priority Data

Mar. 23, 2021 (AU) ..... 2021900852

(51) Int. Cl.
*A41C 3/00* (2006.01)

(52) U.S. Cl.
CPC ..... *A41C 3/005* (2013.01)

(58) Field of Classification Search
CPC ..... A41B 2400/60
See application file for complete search history.

(56) References Cited

U.S. PATENT DOCUMENTS

| | | | | |
|---|---|---|---|---|
| 2,891,544 | A | 6/1959 | London | |
| 5,149,336 | A | 9/1992 | Clarke et al. | |
| 5,385,502 | A * | 1/1995 | Moretz | A41D 20/00 450/32 |
| 6,881,123 | B1 * | 4/2005 | Klakauskas | A41C 3/10 450/39 |
| 7,442,110 | B2 * | 10/2008 | Gaudet | A41C 3/144 450/39 |
| 8,419,503 | B2 * | 4/2013 | Zhang | A41C 3/122 450/39 |
| 2002/0155786 | A1 | 10/2002 | Querquant | |
| 2003/0220048 | A1 | 11/2003 | Toro et al. | |

(Continued)

FOREIGN PATENT DOCUMENTS

| | | | |
|---|---|---|---|
| AU | 2018204530 | A1 | 1/2019 |
| CN | 109662356 | A | 4/2019 |

(Continued)

OTHER PUBLICATIONS

The extended European Search Report issued on Jan. 24, 2025, by the European Patent Office in corresponding European Application No. 22773804.4. (12 pages).

(Continued)

*Primary Examiner* — Jocelyn Bravo
(74) *Attorney, Agent, or Firm* — BUCHANAN INGERSOLL & ROONEY PC

(57) ABSTRACT

A moisture management moulded bra cup and bra containing same for wicking bodily fluid away from a wearer's skin.

13 Claims, 2 Drawing Sheets

(56) References Cited

U.S. PATENT DOCUMENTS

2005/0255789 A1* 11/2005 Gaudet ..... A41C 3/0085 450/41
2006/0160468 A1* 7/2006 Chen ..... A41C 3/146 450/57
2008/0096465 A1* 4/2008 Liu ..... A41C 3/0014 450/39
2009/0098803 A1* 4/2009 Reinisch ..... A41C 3/0014 450/86
2010/0056022 A1* 3/2010 Liu ..... A41C 3/12 450/39
2010/0317256 A1* 12/2010 Zhang ..... A41C 3/122 450/38
2012/0010582 A1* 1/2012 Newnam ..... A61F 13/505 604/385.15
2012/0094575 A1* 4/2012 Sokolowski ..... A41C 5/005 450/92
2013/0066288 A1 3/2013 Lin
2013/0225045 A1* 8/2013 Dandapure ..... A41C 3/0014 450/39
2013/0316615 A1* 11/2013 Hurd ..... A41D 31/125 264/45.3
2016/0227845 A1* 8/2016 Hurd ..... A41C 5/005
2017/0119063 A1* 5/2017 Diaz ..... D04B 1/106
2017/0290377 A1* 10/2017 Liu ..... A41C 3/14
2020/0085113 A1* 3/2020 Rendone ..... A41C 3/10
2022/0047001 A1* 2/2022 Huyghe ..... A41C 3/144

FOREIGN PATENT DOCUMENTS

WO 2016156922 A1 10/2016
WO 2017192049 A1 11/2017

OTHER PUBLICATIONS

International Search Report (PCT/ISA/210) and Written Opinion (PCT/ISA/237) mailed on May 20, 2022 by the Australian Patent Office as the International Searching Authority for International Application No. PCT/AU2022/050264. (13 pages).
International search report issued Mar. 3, 2022, by the Australian Patent Office in corresponding Australian Patent Application No. 2021900852 (20 pages).
Examination report issued Sep. 5, 2025, by the by the Australian Patent Office in corresponding Australian Patent Application No. 2022242175 (3 pages).
Communication pursuant to Article 94(3) EPC issued Oct. 8, 2025, by the European Patent Office in European Patent Application No. 22773804.4-1015 (8 pages).

* cited by examiner

MOISTURE MANAGEMENT BRA

FIELD OF THE INVENTION

The invention relates to a launderable moisture management bra comprising moisture management thermomoulded 3D bra cups, as well as garments comprising bodily fluid wicking bra cup assemblies, for example, a maternity/breast feeding bra, a sweat proof vest or top.

BACKGROUND TO THE INVENTION

Garments capable of managing bodily fluid leaks and secretions such as breast milk and sweat are rapidly becoming a preferred solution to one or more problems including unwanted wet marks or stains, leaks, odour. Such garments appeal to consumers not wishing to use disposable, bulky and uncomfortable liners and pads which often include plastic and non-recyclable material components. Although reusable pads and liners are also available, these products tend to be bulky, uncomfortable, visible through certain types of clothing, and tend to move around which may lead to staining or wetting of outer garments.

A known method of making a bra cup involves cutting bra cup components from a desired fabric and then sewing them together to form a breast/bra cup shape which is then incorporated into a garment. However, for certain fabrics, particularly synthetic fabrics such as polyester, and solid foam materials, it is possible to make seamless bra cups by compression moulding and/or thermo moulding, for example, which softens a polyester fabric by heating and/or applying pressure forces when placed over a shaped mould, for example, a bullet shaped mould in the case of a bra cup. Where a foam component is used, padded seamless cups can be produced. After moulding the resultant moulded cup is trimmed or cut according to the particular garment design. A typical mould is formed from a male bullet shaped convex part which is typically aluminium and a female concave part also usually of aluminium. The process is known as bullet or bubble moulding and involves placing the fabric between male and female moulding parts using a bra cup moulding machine and compressing or biting the parts together while applying heat. The resulting heating and compression forces stretches, deforms or compresses certain areas of the fabric. Stretching particularly occurs at the bust point region of the bullet mould, while areas of the cup remote to the bust point are increasingly less stretched as they experience less and less deforming forces during moulding. Likewise, areas of the cup close to the base of the mould are subjected to the most compressive forces compared to the bust point which typically is arranged so as to have a nice rounded, smooth appearance after moulding. The stretched and deformed regions of the cup can be observed microscopically or even by holding the moulded bra cup against a light source.

Importantly, not all fabrics are considered as suitable for moulding. For example, the fabric must have an appropriate heat set properties so that the fabric adopts and retains its moulded shaped during normal use and laundering. Certain fabrics do not heat set well or do not heat set for long periods of time. Other fabrics are damaged on application of the heat at the temperatures involved in moulding. The stretchability and/or resilience of the fabric is also an important factor. Indeed, traditional thinking is that warp knit or circular knit fabrics are typically considered as only being suitable for moulding. Insufficiently elastic or stretchable fabrics can tear or split under the required moulding forces. Furthermore, the fabric must be one that does not discolour to any significant degree due to the moulding process and must not become too brittle after heat is applied. Other issues can arise from the incorrect selection of fabric or foam and/or selection of incompatible fabrics and/or foam. Furthermore, there can be issues with yarn/fabric misalignment and mismatch in terms of temperatures to be applied and stretchability. Typical defects include fabric melting, bursting, deformation out of the moulded shape, uneven thickness in cup rim area, shrinkage, excessive discolouration, Moire shadowing, undulating, puckered or orange skin surfaces all of which result in an unusable bra cup. Therefore, it is clear that selecting suitable fabrics for moulding into a 3D shape is not a trivial exercise and in particular there are significant difficulties in moulding complex fabric assemblies for example by bullet or bubble moulding such that this area has had little focus to date.

The present invention seeks to provide bra cups and garments comprising such bra cups, for example, for everyday use, or to be worn during exercise and/or breast feeding periods. An object of one embodiment of the invention is provision of moulded 3D breast/bra cups which have excellent moisture management capabilities, and which are capable of managing fluid (e.g., sweat, breast milk/discharge).

A reference herein to a patent document or any other matter identified as prior art, is not to be taken as an admission that the document or other matter was known or that the information it contains was part of the common general knowledge as at the priority date of any of the claims.

Where any or all of the terms "comprise", "comprises", "comprised" or "comprising" are used in this specification (including the claims) they are to be interpreted as specifying the presence of the stated features, integers, steps or components, but not precluding the presence of one or more other features, integers, steps or components.

STATEMENTS OF THE INVENTION

As disclosed herein, there is provided a moisture management moulded 3D bra cup for supporting breasts in a garment, wherein the bra cup comprises a moulded 3D breast/bra cup shaped laminated assembly comprising parts as follows:

- a fluid wicking fabric component for wicking bodily fluid from a wearer's skin and having a first face contactable against the wearer's skin during normal use and having a second face laminated to a first face of a fluid trapping core element for protecting the garment from fluid leaks by trapping wicked bodily fluid therein,
- wherein a second face of the fluid trapping core element is laminated to a first side of a moisture barrier component, wherein an outer face of the moisture barrier component faces away from the wearer's breast skin during normal use,
- wherein each part in the assembly adopts a moulded 3D breast/bra cup shape.

Suitably, the moulded cups are thermomoulded 3D cups.

According to a first aspect of the invention, there is provided a launderable bra comprising moisture management thermomoulded 3D bra cups for supporting breasts, wherein each bra cup comprises a thermomoulded 3D breast/bra cup shaped laminated assembly comprising parts as follows:

- a fluid wicking fabric component for wicking bodily fluid from a wearer's skin and having a first face contactable against the wearer's skin during normal use and having a second face laminated to a first face of a fluid trapping core element for protecting the garment from fluid leaks by trapping wicked bodily fluid therein, wherein a second face of the fluid trapping core element is laminated to a first side of a moisture barrier fabric component, wherein an outer face of the moisture barrier fabric component faces away from the wearer's breast skin during normal use, wherein each part in the assembly adopts a thermomoulded 3D breast/bra cup shape.

Desirably, the at least one of the fluid wicking fabric component, and the moisture barrier fabric component comprises fibres, at least a portion of which are stretched into a more open structure after thermomoulding compared to an equivalent component before thermomoulding.

Desirably, the bra cup is stitchless and/or seamless. The parts may comprise various components and/or elements which are laminated together by thermomoulding to form a thermomoulded fabric laminate assembly. The components may be fabric components, polymer components (preferably biodegradable polymers including those in the form of foams), fabric components (preferably biodegradable fabrics), foam elements (preferably biodegradable foam elements), or combinations thereof. Each part may optionally be treated with one or more agents such as moisture resistant or repellent polymers, antimicrobials, anti-odour agents and the like. Preferred parts are fabric components. Preferred elements are polymer/foam elements or a combination of fabric and foam elements. Thus, in some embodiments, the parts may be a mixture of fabrics and polymer/foam. In one embodiment, the parts are a mixture of biodegradable fabric components and biodegradable polymer/foam components. In another embodiment, the components are a mixture of fabric components and polymer/foams comprising at least one biodegradable polymer/foam or at least one recycled polymer/foam. In some embodiments, the fabric components are untreated. Particularly preferred parts are biodegradable. The term "biodegradable" as used herein includes the meaning compostable in active soil (with microbes) in a timeframe of 5 years or less. Desirably, at least 95% or greater of the launderable bra is biodegradable and/or compostable in active soil in 5 years or less. Desirably, at least 97% or greater of launderable bra is biodegradable and/or compostable in active soil in 2 years or less. Desirably, at least 99% or greater of the launderable bra is biodegradable and/or compostable in active soil in 2 years or less. Desirably, at least 100% of the launderable bra is biodegradable and/or compostable in active soil in 2 years or less.

Preferably, the fluid trapping core element comprises one or more of fluid trapping fabric components and at least one fluid trapping bra cup scaffold component for supporting a wearer's breast, for providing structure to the assembly and for enhancing the fluid trapping capability of the fluid trapping fabric component as required. In some aspects of the invention, the fluid trapping core element comprises a fluid trapping fabric component only, for example, where support and structure is not important. In other aspects, the fluid trapping core element comprises a fluid trapping bra cup scaffold component only, for example, where support and structure is important and lower volumes of bodily fluid are involved, such as sweat. In some preferred embodiments, the fluid trapping core element includes both a fluid trapping fabric component and a fluid trapping bra cup scaffold component, for example, where support, structure and maximum moisture management capability is required, such as maternity bra applications. When used together in the fluid trapping core element, faces of the fluid trapping fabric component and the fluid trapping bra cup scaffold component are fused or laminated together by adhesive, as elsewhere described herein. Thus, in some embodiments, a first face of the fluid trapping bra cup scaffold component is laminated to a second face of the fluid trapping fabric component. Together these components form the fluid trapping core element described above, whereby a second face of the bra cup scaffold component then corresponds to the second face of the fluid trapping core element laminated to the first side of the moisture barrier fabric component as set out above. Thus, it will be clear that while inclusion of a bra cup scaffold is preferred, it is not essential to the invention. Thus, in some embodiments, a fluid trapping core element consisting only of a fluid trapping fabric component will be sufficient, for example, in sportswear where the major bodily fluid is sweat. Where a cup with more structure is required, the fluid trapping bra cup scaffold component may be used alone in place of the fluid trapping fabric component just described especially where the scaffold has standalone fluid trapping ability. The invention thus relates to a bra with thermomoulded bra cup comprising a fabric only assembly (without a scaffold such as polymeric/foam) or a fabric-non-fabric, e.g. foam composite assembly.

Suitably, the fluid trapping bra cup scaffold component is of a fluid trapping material such as a foam, particularly an open cell foam which can itself absorb moisture/fluid as described herein. Suitable foams include polyurethane based foam or polyester based foam, though biodegradable foams or at least partly biodegradable and/or compostable foams (such as plant based including corn or soy based foams) are more preferred. For example, coffee derived, biobased latex and biobased PLA bra cup and spacer bra cups are available under the M-Tec® brand from Muehlmeier (https://www.muehlmeier.eu/sustainable-eco-optimized-bracups.html). Recycled or biodegradable foam cups, such as partly biodegradable foam cups, are available, for example, from SealBracup, see http://www.sealbra-cup.com, or from manufacturers such as Hizhou Hengguang Polyurethane Materials Co., Ltd. In some embodiments, partly biodegradable foam cups are used having any suitable proportion by weight of a biodegradable component. In some embodiments, the proportion of biodegradable component in the foam component of the bra cup is between about 30% and 50%, such as about 39%-40%, but may be up to 80% in other embodiments. In some embodiments, partly biobased foam cups are used having any suitable proportion by weight of a biobased carbon component. In some embodiments, the proportion of biobased carbon in the foam component of the bra cup is between about 30% and 50%, such as about 39%-40%, but may be up to 80% in other embodiments. However, foam components which are 100% biodegradable and/or compostable when buried in active soil are most preferred.

As disclosed herein, the invention provides a moisture management moulded 3D bra cup for supporting breasts in a garment, wherein the bra cup comprises a moulded 3D breast/bra cup shaped assembly comprising parts as follows:

a fluid wicking fabric component for wicking bodily fluid from a wearer's skin and having a first face contactable against the wearer's skin and having a second face laminated to a fluid trapping core element comprising a first face of a fluid trapping fabric component for protecting the garment from fluid leaks by trapping wicked bodily fluid therein, wherein a second face of the fluid trapping fabric component is laminated to a first face of a fluid trapping bra cup scaffold component for supporting a wearer's breast and providing structure to the assembly, wherein a second face of the bra cup scaffold component of the core element is laminated to a first side of a moisture barrier component, wherein an outer face of the moisture barrier component faces away from the wearer's breast skin, wherein each part in the assembly adopts the moulded 3D breast/bra cup shape.

In one embodiment, there is provided a launderable moisture management bra according to the first aspect above, wherein each thermomoulded 3D breast/bra cup shaped laminated assembly comprises parts as follows:

a fluid wicking fabric component for wicking bodily fluid from a wearer's skin and having a first face contactable against the wearer's skin and having a second face laminated to a fluid trapping core element comprising a first face of a fluid trapping fabric component for protecting the garment from fluid leaks by trapping wicked bodily fluid therein, wherein a second face of the fluid trapping fabric component is laminated to a first face of a fluid trapping bra cup scaffold component for supporting a wearer's breast and providing structure to the assembly, wherein a second face of the bra cup scaffold component of the core element is laminated to a first side of a moisture barrier fabric component, wherein an outer face of the moisture barrier fabric component faces away from the wearer's breast skin, wherein each part in the thermomoulded laminated assembly adopts the moulded 3D breast/bra cup shape.

As disclosed herein, there is provided a garment having included therein a moisture management moulded 3D breast/bra cup of the invention as described herein. For example, the garment may be a maternity bra, a singlet bra, a t-shirt bra, or a sports bra.

As disclosed herein, there is provided a method of manufacturing a moisture management 3D moulded 3D breast/bra cup comprising the steps of:

laminating a moisture barrier fabric component to a fluid trapping core element to form a first flat (2D) subassembly;

laminating a fluid wicking fabric component over the fluid trapping core element of the first flat (2D) subassembly to form a flat (2D) precursor construct;

moulding the flat (2D) precursor construct into a desired moulded 3D breast/bra cup shaped assembly such that the fluid wicking component forms an inner concave face of the moulded 3D breast/bra cup for contacting skin and the moisture barrier fabric component forms an outer convex face of the moulded 3D breast/bra cup. It will be understood that the order of laminating steps in not limiting for this embodiment. Preferably the moulding step involves thermomoulding. As explained above, the fluid trapping core element may comprise one or more of a fluid trapping fabric component and a fluid trapping bra cup scaffold component for supporting a wearer's breast, for providing structure to the assembly and for enhancing the fluid trapping capability of the fluid trapping fabric component as required.

According to a second aspect of the present invention, there is provided a method of manufacturing moisture management thermomoulded 3D bra cups for a launderable moisture management bra comprising assembling parts via the steps of:

laminating a moisture barrier fabric component to a fluid trapping core element to form a first flat (2D) subassembly;

laminating a fluid wicking fabric component over the fluid trapping core element of the first flat (2D) subassembly to form a flat (2D) precursor construct;

thermomoulding the flat (2D) precursor construct into a desired thermomoulded 3D breast/bra cup shaped laminated assembly such that the fluid wicking fabric component forms an inner concave face of each thermomoulded 3D bra cup for contacting skin and the moisture barrier fabric component forms an outer convex face of each thermomoulded 3D breast/bra cup. Preferably, the flat (2D) precursor construct is heated and/or compressed over a 3D bra cup-shaped mould for a period of time sufficient to adopt the shape of the 3D bra cup-shaped mould, whereby after thermomoulding, the fluid wicking fabric component forms a concave face of each thermomoulded 3D bra cup for contacting skin.

As explained above, the fluid trapping core element may comprise one or more of a fluid trapping fabric component and a fluid trapping bra cup scaffold component for supporting a wearer's breast, for providing structure to the assembly and for enhancing the fluid trapping capability of the fluid trapping fabric component as required.

As disclosed herein, there is provided a method of manufacturing a moisture management moulded 3D breast/bra cup comprising the steps of:

laminating a moisture barrier fabric component to a scaffold component of a fluid trapping core element to form a first flat (2D) subassembly;

laminating a fluid trapping fabric component over the scaffold component of the first flat (2D) subassembly thereby forming a second flat (2D) subassembly;

laminating a fluid wicking fabric component over the fluid trapping fabric component of the fluid trapping core element of the second flat (2D) subassembly to form a flat (2D) precursor construct;

moulding the flat (2D) precursor construct into a desired moulded 3D breast/bra cup shaped assembly such that the fluid wicking component forms an inner concave face of the moulded 3D breast/bra for contacting skin and the moisture barrier fabric component forms an outer convex face of the moulded 3D breast/bra. It will be understood that the order of steps is not limiting for this embodiment.

According to a third aspect of the present invention, there is provided a method of manufacturing moisture management thermomoulded 3D bra cups for a launderable moisture management bra comprising assembling parts via the steps of:

laminating a moisture barrier fabric component to a fluid trapping core element to form a first flat (2D) subassembly;

laminating a fluid wicking fabric component over the fluid trapping core element of the first flat (2D) subassembly to form a flat (2D) precursor construct;

thermomoulding the flat (2D) precursor construct into a desired thermomoulded 3D breast/bra cup shaped laminated assembly such that the fluid wicking fabric component forms an inner concave face of each thermomoulded 3D bra cup for contacting skin and the moisture barrier fabric component forms an outer convex face of each thermomoulded 3D breast/bra cup, whereby the flat (2D) precursor construct is heated and/or compressed over a 3D bra cup-shaped mould for a period of time sufficient to adopt the shape of the 3D bra cup-shaped mould, whereby after thermomoulding, the fluid wicking fabric component forms a concave face of each thermomoulded 3D bra cup for contacting skin.

Desirably, the fluid trapping core element comprises (i) a fluid trapping fabric component only, (ii) a fluid trapping bra cup scaffold component only, or (iii) a combination of a fluid trapping fabric component and a fluid trapping bra cup scaffold component. In some embodiments, a core having only a fluid trapping bra cup scaffold component is particularly preferred.

Preferably the moulding step involves thermomoulding. Preferably, the fluid trapping core element comprises one or more of a fluid trapping fabric component and a fluid trapping bra cup scaffold component. In some embodiments, the fluid trapping core element comprises a fluid trapping fabric component only. In other embodiments, the fluid trapping core element comprises a fluid trapping bra cup scaffold component only.

As disclosed herein, there is provided a moisture management flat (2D) precursor construct for moulding into a moulded 3D breast/bra assembly comprising:

a fluid wicking fabric component for wicking bodily fluid from a wearer's skin and having a first face contactable against the wearer's skin and a second face laminated to a first face of a fluid trapping core element for protecting the garment from fluid leaks by trapping wicked bodily fluid therein, wherein a second face of the fluid trapping core element is laminated to a first side of a moisture barrier fabric component.

According to a fourth aspect of the present invention, there is provided a moisture management flat (2D) construct for moulding into a thermomoulded 3D breast/bra cup shaped laminated assembly for a launderable moisture management bra, the construct comprising:

a fluid wicking fabric component for wicking bodily fluid from a wearer's skin in use and having a first face contactable against the wearer's skin in use and a second face laminated to a first face of a fluid trapping core element for protecting the bra from fluid leaks by trapping wicked bodily fluid therein, wherein a second face of the fluid trapping core element is laminated to a first side of a moisture barrier fabric component.

As explained above, the fluid trapping core element may comprise one or more of a fluid trapping fabric component and a fluid trapping bra cup scaffold component for supporting a wearer's breast, for providing structure to the assembly and for enhancing the fluid trapping capability of the fluid trapping fabric component as required.

As disclosed herein, there is provided a moisture management flat (2D) precursor construct for moulding into a moulded 3D breast/bra assembly comprising:

a fluid wicking fabric component for wicking bodily fluid from a wearer's skin and having a first face contactable against the wearer's skin and a second face laminated to a first face of a fluid trapping fabric component of a fluid trapping core element for protecting the garment from fluid leaks by trapping wicked bodily fluid therein, and wherein a second face of the fluid trapping fabric component is laminated to a first face of a bra cup scaffold component of the core element for supporting a wearer's breast, wherein a second face of the bra cup scaffold component is laminated to a first side of a moisture barrier fabric component.

Also described herein is a moisture management flat (2D) construct for moulding into a thermomoulded 3D breast/bra cup shaped laminated assembly for a launderable moisture management bra, the construct comprising:

a fluid wicking fabric component for wicking bodily fluid from a wearer's skin in use and having a first face contactable against the wearer's skin in use and a second face laminated to a first face of a fluid trapping fabric component of a fluid trapping core element for protecting the bra from fluid leaks by trapping wicked bodily fluid therein, and wherein a second face of the fluid trapping fabric component is laminated to a first face of a bra cup scaffold component of the fluid trapping core element for supporting a wearer's breast in use, wherein a second face of the bra cup scaffold component is laminated to a first side of a moisture barrier fabric component.

Also described in a related embodiment is a moisture management flat (2D) construct for moulding into a thermomoulded 3D breast/bra cup shaped laminated assembly for a launderable moisture management bra, the construct comprising:

a fluid wicking fabric component for wicking bodily fluid from a wearer's skin in use and having a first face contactable against the wearer's skin in use and a second face laminated to a first face of a fluid trapping bra cup scaffold component of a fluid trapping core element for supporting a wearer's breast in use, wherein a second face of the fluid trapping bra cup scaffold component is laminated to a first side of a moisture barrier fabric component.

As disclosed herein, there is provided a method of manufacturing a flat (2D) moisture management precursor construct for forming a moisture management moulded 3D breast/bra cup as described herein, comprising the steps of:

laminating a moisture barrier fabric component to a fluid trapping core element thereby forming a first (2D) subassembly;

laminating a fluid wicking fabric component over the fluid trapping core element of the first flat (2D) subassembly to form a flat (2D) precursor construct for moulding. It will be understood that the order of steps in not limiting for this embodiment.

According to a fifth aspect of the present invention, there is provided a method of manufacturing a flat (2D) moisture management construct for forming moisture management thermomoulded 3D bra cups of a launderable bra, the method comprising the steps of:

laminating a moisture barrier component to a fluid trapping bra cup scaffold component of a fluid trapping core element to form a first flat 2D subassembly;

laminating a fluid trapping fabric component over a fluid trapping bra cup scaffold component of the first flat (2D) subassembly thereby forming a second flat (2D) subassembly;

laminating a fluid wicking fabric component over the fluid trapping fabric component of the second flat (2D) subassembly to form a flat (2D) precursor construct ready for thermomoulding into a 3D bra cup.

Also described is a method of manufacturing a flat (2D) moisture management precursor construct for forming the moisture management thermomoulded 3D bra cups of a launderable bra, the method, comprising the steps of:

laminating a moisture barrier component to a fluid trapping core element thereby forming a first (2D) subassembly;

laminating a fluid wicking fabric component over the fluid trapping core element of the first flat (2D) subassembly to form a flat (2D) precursor construct for thermomoulding.

As disclosed herein, there is provided a method of manufacturing a flat (2D) moisture management precursor construct for forming a moisture management moulded 3D breast/bra cup as described herein, comprising the steps of:

laminating a moisture barrier fabric component to a bra cup scaffold component of a fluid trapping core element to form a first flat 2D subassembly;

laminating a fluid trapping fabric component over the bra cup scaffold component of the first flat (2D) subassembly thereby forming a second flat (2D) subassembly;

laminating a fluid wicking fabric component over the fluid trapping fabric component of the second flat (2D) subassembly to form a flat (2D) precursor construct ready for moulding. It will be understood that the order of steps in not limiting for this embodiment.

Also described is a method of manufacturing a flat (2D) moisture management construct for forming moisture management thermomoulded 3D bra cups of a launderable bra, the method comprising the steps of:

laminating a moisture barrier component to a fluid trapping bra cup scaffold component of a fluid trapping core element to form a flat 2D subassembly;

laminating a fluid trapping fabric component the fluid trapping bra cup scaffold component of the flat (2D) subassembly to form a flat (2D) precursor construct ready for thermomoulding into a 3D bra cup.

Suitably the bra cups of the invention may sit in a bra cradle, the bra cradle comprising the moisture management flat (2D) construct of the invention. It will be understood that in such case, the 2D construct is generally not moulded. The laminated layers of the flat assembly are used to fabricate the bra cradle. Usefully, this increases the moisture management areas of the bra beyond the breasts. In one embodiment, the cradle assembly may comprise a fabric wicking layer (preferably Merino), laminated onto a polymeric foam (preferably a polyurethane foam, most preferably a biodegradable foam) which is itself laminated onto a base barrier layer (preferably a polyester) which may be treated with at least one water repellent polymer or organic treatment. If desired, the barrier layer may comprise the treated polyester and an outer layer, for example, an outer layer of a nylon elastane (preferably a recycled nylon elastane).

BRIEF DESCRIPTION OF THE DRAWINGS

Described herein are moisture management moulded 3D bra cups for supporting breasts in a garment. A flat (2D) laminated precursor construct for fabrication of the moisture management moulded bra cup of the invention is also described. Garments comprising such moisture management moulded bra cups are also described. Method of manufacture of the moisture management moulded 3D bra cup and the flat (2D) laminated precursor construct are also described.

Further features of the present invention are more fully described in the following description of several non-limiting embodiments included solely for the purposes of exemplifying the present invention. The following description is not a restriction on the broad summary, disclosure or description of the invention as set out above and is made with reference to the accompanying drawings in which.

DETAILED DESCRIPTION OF THE INVENTION

Figure 1:
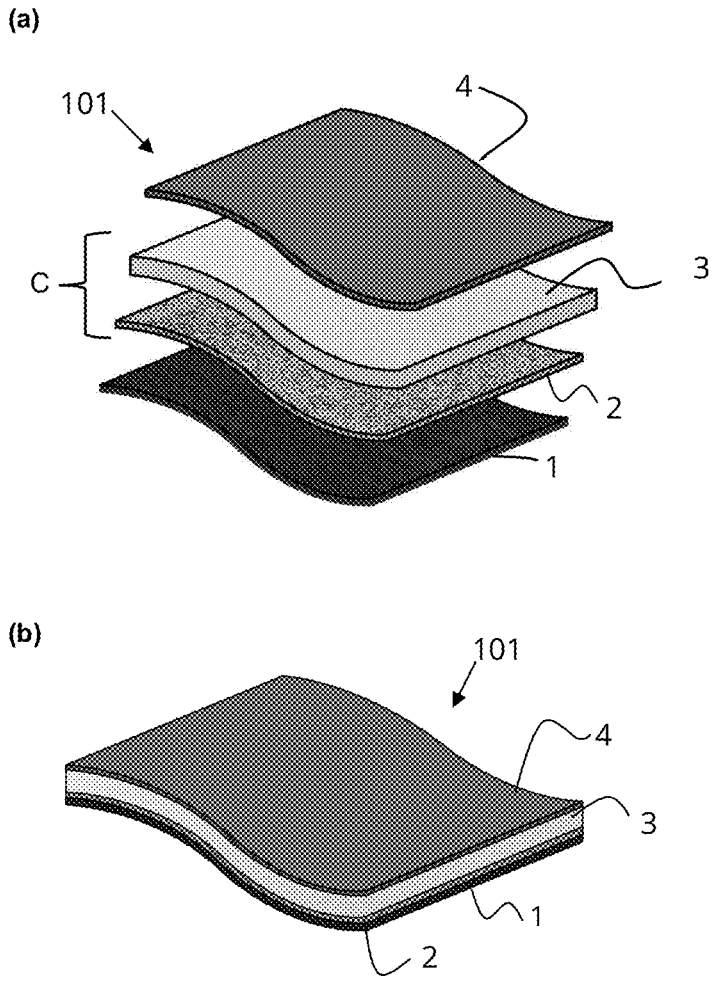
FIG. 1 a schematic drawing illustrating (a) an exploded view of a preferred embodiment of a flat (2D) precursor construct (pre moulding) for assembly of a moulded bra cup of the invention; and (b) a view of a preferred embodiment of a flat (2D) laminated precursor construct (pre moulding) of an assembly of a moulded bra cup of the invention.

The invention relates to a moisture management moulded 3D bra cup for supporting breasts in a garment. The bra cup comprises a moulded 3D breast/bra cup shaped assembly. The assembly comprises a fluid wicking fabric component for wicking bodily fluid from a wearer's skin and having a first face contactable against the wearer's skin and having a second face laminated to a first face of a fluid trapping core element for protecting the garment from fluid leaks by trapping wicked bodily fluid therein. Suitably, a second face of the fluid trapping core element is laminated to a first side of a moisture barrier component, wherein an outer face of the moisture barrier component faces away from the wearer's breast skin during use. Suitably, each component in the assembly adopts a moulded 3D breast/bra cup shape. The fluid trapping core element may include one or more of a fluid trapping fabric component and a fluid trapping bra cup scaffold component for supporting a wearer's breast and providing structure to the assembly. Desirably, a first face of the fluid trapping bra cup scaffold component is laminated to a second face of the fluid trapping fabric component to form the fluid trapping core element. A second face of the fluid trapping bra cup scaffold component then corresponds to the second face of the fluid trapping core element laminated to the first side of the moisture barrier component. When the fluid trapping bra cup scaffold component is present and is of a fluid absorbing material, the moisture/fluid retention capability of the fluid trapping core fabric is supported/supplemented giving a core that can accommodate additional moisture over what is possible with the fluid trapping fabric component alone.

Reference herein to the terms "scaffold", "cup scaffold", "bra cup scaffold", "bra cup scaffold component", "bra cup shaped scaffold component", "foam scaffold", and the like will be understood to be referring to the fluid trapping bra cup scaffold component unless the context clearly indicates otherwise.

Reference herein to the terms "core element", "core", and the like will be understood to be referring to the fluid trapping core element unless the context clearly indicates otherwise.

Reference herein to the terms "assembly", "laminated assembly", "cup shaped assembly", "3D breast/bra cup shaped assembly", "moulded bra cup assembly", "moulded bra cup shaped assembly" and the like will be understood to be referring to the moulded, in some embodiments thermomoulded, 3D breast/bra cup shaped laminated assembly unless the context clearly indicates otherwise.

As used herein, the term "thermomoulded" and related terms "thermo moulding", "thermocompression", "thermo-compressed", "heat moulded", "heat moulded under pressure", and the like will be understood to refer to a process by which two or more component layers are pressed together under pressure and with the application of heat unless the context clearly indicates otherwise. In preferred embodiments, thermomoulding and related terms comprise application of uneven pressure to the two or more component layers, such as through use of bullet moulds, to achieve a breast/bra cup shape. In such embodiments, compressive and stretching forces are not uniform throughout the assembly or component layers thereof during moulding of the assembly.

In a preferred embodiment, there is provided a fluid wicking fabric component for wicking bodily fluid from a wearer's skin and having a first face contactable against the wearer's skin and having a second face laminated to a first face of a fluid trapping core element for protecting the garment from fluid leaks by trapping wicked bodily fluid therein, wherein a second face of the fluid trapping core element is laminated to a first face of a bra cup scaffold component for supporting a wearer's breast and providing structure to the assembly (and in some embodiments providing additional/supplemental fluid trapping functionality), wherein a second face of the bra cup scaffold component is laminated to a first side of a moisture barrier component, wherein an outer face of the moisture barrier component faces away from the wearer's breast skin, wherein each component in the assembly adopts a moulded 3D breast/bra cup shape.

In a related aspect, the moisture management moulded bra cup for supporting breasts in a garment may be provided as a moulded bra cup shaped assembly comprising layered components each having a pair of opposing faces, wherein the components comprise: a fluid wicking fabric component for wicking bodily fluid from the skin and having a first face contactable against a wearer's skin and a second face laminated to a first face of a fluid trapping core element for protecting the garment from fluid leaks by trapping wicked bodily fluid, wherein a second face of the fluid trapping core element is laminated to a first face of a scaffold component for supporting a wearer's breast, wherein a second face of the scaffold component is laminated to a first side of a moisture barrier fabric component, wherein an outer face of the moisture barrier fabric component faces away from the wearer's skin.

In such embodiments, the scaffold forms part of the wicking/trapping core fabric arrangement. In preferred embodiments, the bra cup shaped scaffold component is disposed or sandwiched in the assembly between the fluid trapping fabric component and the moisture barrier component.

The scaffold provides the bra cup with structure on moulding and gives the bra cup a smooth surface appearance. Depending on the nature of the scaffold material used, the scaffold may enhance the function of the trapping core element by acting as a reservoir for additional wicked fluid.

Desirably, the moulded assembly comprises a fluid trapping core element sandwiched between a fluid wicking component and the moisture barrier component. The moisture barrier component may be disposed on the outer side/convex side of the scaffold component. The fluid wicking component is contactable against the wearer's skin for wicking bodily fluid from the skin into the core element. The moisture barrier component is for protecting the garment from fluid leaks from the fluid trapping core element. In some embodiments the core comprises (a) fluid trapping fabric alone, (b) bra cup scaffold alone, (c) a combination of fluid trapping fabric laminated to a bra cup scaffold. Where the bra cup scaffold has fluid absorption ability it can function as a core alone without the fluid trapping fabric or can provide enhanced fluid trapping ability when included in conjunction with the fluid trapping core. In some embodiments, the fluid trapping bra cup scaffold component may comprise two or more layers. In some embodiments, the layers may be the same. In such embodiments, the fluid trapping bra cup scaffold component may comprise two or more layers of a single type of foam, in some embodiments an open cell foam as described elsewhere herein. In some embodiments, fluid trapping bra cup scaffold component may comprise two or more layers wherein the layers are different. In such embodiments, the fluid trapping bra cup scaffold component may comprise two or more layers of different types of foam, in some embodiments open cell foams having different compositions. In other embodiments, the invention provides a moisture management moulded bra cup for supporting breasts in a garment, the bra cup comprises a moulded 3D breast/bra cup shaped fabric assembly comprising

- a bra cup shaped scaffold component having an outer convex face and an inner concave face having bonded on the inner concave face as a bra cup shaped assembly:
- the fluid trapping core element sandwiched between a fluid wicking component contactable against the wearer's skin for wicking bodily fluid from the skin into the core element and a moisture barrier component for protecting the garment from fluid leaks from the fluid trapping core element, wherein the leakproof barrier component contacts the inner concave face of the scaffold component,
- wherein the fluid trapping core element in conjunction with the leakproof barrier component traps wicked bodily fluid in the fluid trapping core element.

In a related embodiment, there is provided a moisture management moulded bra cup for supporting breasts in a garment and for wicking bodily fluid away from a wearer's skin into a fluid trapping core element of the moulded bra cup, the moulded bra cup comprising: a breast/bra cup shaped scaffold component having an outer convex face and an inner concave face having bonded on the inner concave face as a moulded assembly: the fluid trapping core element sandwiched between a fluid wicking fabric component contactable against the wearer's skin for wicking bodily fluid from the skin into the core element and a moisture barrier component for protecting the garment from fluid leaks from the fluid trapping core element, wherein the moisture barrier component contacts the inner concave face of the scaffold component, wherein the fluid trapping core element in conjunction with the moisture barrier component traps wicked bodily fluid in the fluid trapping core element, and wherein each component of the assembly is entirely laminated to that component's neighbouring components.

In some embodiments, the moulded bra cup is in the form of a fabric composite made up of several fabric layers intimately disposed together in a sandwiched configuration to form a fabric assembly which is laminated, bonded or fused onto a bra cup scaffold component during manufacture and formed into a breast/bra cup shape via a moulding process, for example as described herein. It will be understood that in some embodiments, the breast/bra cup shaped scaffold component has an outer convex side or face and an inner concave side or face having attached, on the inner concave face, a moisture management and moulded assembly comprising a fluid wicking fabric component, fluid trapping core element and a moisture barrier component, as described herein. In such embodiments, the bra cup scaffold may be bonded or laminated, on the inner concave face, to a moisture management and moulded assembly comprising a fluid wicking fabric component, fluid trapping core element and a moisture barrier component, as described herein. In such embodiments, the bra cup scaffold may alternatively be stitched to a moisture management and moulded assembly comprising a fluid wicking fabric component, fluid trapping core element and a moisture barrier component, as described herein, provided that the fluid wicking fabric component, the fluid trapping core element and the moisture barrier component are laminated together in the form of a laminated assembly as described herein. The bra cup scaffold in this embodiment may be a fluid trapping bra cup scaffold component as described herein, or may be a bra scaffold component devoid of fluid trapping capabilities, or substantially devoid of fluid trapping capabilities, or having fluid trapping capabilities at least 20% lower, or at least 30% lower, or at least 50% lower than the fluid trapping capacity of the fluid trapping bra cup scaffold component as described herein.

In the moulded bra cup assembly described herein, each component of the assembly is bonded, laminated or fused to its neighbouring component. Desirably, the entire face of each component contacting a neighbouring component is entirely laminated to one face of that other component such that there are no unlaminated or delaminated areas in the moulded bra cup of the invention. Laminating the component layers of the assembly herein means the scaffold (e.g., foam) and/or outer face of the moisture barrier fabric component of the bra cup are smooth and do not comprise visible undulations, puckering and/or an orange peel or orange skin appearance. By 'visible' it is meant determinable to the average naked eye. The laminating of component layers may be achieved by any suitable means known in the art, such as with an adhesive material as described further herein below.

Desirably, the moisture management moulded bra cup also supports and/or lifts breasts when incorporated into a garment. It will be understood that the moulded bra cup may be used with, or as part of, a garment, e.g., active or sportswear, underwear, maternity or breastfeeding garments or the like. Desirably, the moulded bra cup of the invention and associated garment is made of one or more components including textile fabrics, that are, launderable either by hand or by machine and yet retain their structural and functional role, even after multiple washing and/or drying cycles. Desirably, garments comprising the moulded bra cups described herein are launderable either by hand or by machine. In some embodiments, the garment is a bra comprising the moulded 3D bra cups as described herein. In some embodiments, such garments/bras may be launderable through at least 1, or at least 2, or at least 3, or at least 5, or at least 10, or at least 20, at least 50 or at least 100 washing cycles and yet still retain their moisture management functionality. In other embodiments, the moulded 3D breast/bra cups described herein are launderable either by hand or by machine. In some embodiments, such moulded 3D breast/bra cups may be launderable through at least 1, or at least 2, or at least 3, or at least 5, or at least 10, or at least 20, at least 50 or at least 100 washing cycles and yet still retain their moisture management functionality. A washing cycle generally comprises a washing step and a drying step, wherein the washing step comprises application of soap or laundry detergent and water with agitation and the drying step comprises exposure to air and/or heat. Launderable moulded 3D breast/bra cups and bras comprising same are to be contrasted with single use or disposable breast pads for use inside a bra, which may be irreversibly damaged by application of washing water and/or laundry detergent and/or agitation and thereby do not retain their structure or functional role of being capable of absorbing moisture after laundering.

Suitably, at least one of the fluid trapping core element, fluid wicking component, and moisture barrier component comprise at least one fabric, preferably a knitted fabric. Knitted or otherwise stretchable fabrics are particularly preferred. Suitable stretchable fabrics include Merino, microfibre in nylon or polyester (or similar in biodegradable, partly biodegradable, or recycled material), lace in nylon/nylon elastane or biodegradable, partly biodegradable, or recycled versions thereof, and/or satin in polyester elastane. Other suitable fabrics include cotton jersey, bamboo, cellulosic based fabrics and semi-synthetic fabrics such as Modal.

Desirably, the bra cup support scaffold is a material selected from a foam, a spacer material, a mesh. Desirably, the bra cup support scaffold is a foam, particularly open cell foams capable of absorbing moisture/fluid. Preferred foams include polyurethane foam, stay-white or semi-stay-white polyurethane foam, memory foam pad, perforated foam, swimwear foam pad, or a foam pad filled with an internal core comprised of gel, air, oil, recycled core (potentially from polyester), fiberfill or recycled fiberfill (fibrefill for example comprising of polyester or recycled polyester fibres). Alternatively, a foam cup could be made from a polyurethane prepolymer capped by vinyl group (PUV), or an eco-foam, e.g., in the form of a polymerized coffee oil foam cup or biobased latex bra cup. In some embodiments, the bra cup scaffold component is a foam. The foam may be biodegradable. The foam may be partly biodegradable. The foam may be partly bio-based, meaning the source of part of the raw materials for the foam are plant-based rather than fossil-fuel based. In one embodiment, the foam comprises at least one biodegradable component, such as a biodegradable polymeric component. In another embodiment, the foam comprises at least one recycled polymer. In embodiments where the foam comprises at least one biodegradable component, such as a biodegradable polymeric component, the biodegradable component may constitute at least 10% by weight of the foam, or at least 20%, or at least 30%, or at least 40%, or at least 60%, or at least 90% by weight of the foam, or between 10 and 80%, or between 20% and 50%, or between 35% and 45%, such as 39%-40%, by weight of the foam. In embodiments where the foam comprises at least one recycled component, such as a recycled polymeric component, the recycled component may constitute at least 10% by weight of the foam, or at least 20%, or at least 30%, or at least 40%, or at least 60%, or at least 80%, or at least 90% by weight of the foam, or between 10 and 80%, or between 20% and 50%, or between 40% and 90% by weight of the foam. In one embodiment, the bra cup scaffold component comprises a polyurethane foam, such as a polyurethane foam formed from a polyether polyol such as Caradol Sc46-02 and toluene diisocyanate. In one embodiment, the bra cup scaffold component comprises a polyurethane foam, such as a polyurethane foam formed from a polyether polyol such as Caradol Sc46-02 and toluene diisocyanate mixed with a biodegradable raw material. In such embodiments, the proportion by weight of polyol to isocyanate to biodegradable material may be about 1:1:1, such as about 30:27:35. A spacer cup could alternatively be made from recycled polyester. Water repellent or antibacterial, anti-odour or anti-microbrial treatments may be applied to one or more of the materials/components, if desired. Preferred foams are polyurethane foams. Suitable foams are available from suppliers including Guangzhou Seal-Beauty Bra Cup (www.sealbra-cup.com), or from manufacturers such as Hizhou Hengguang Polyurethane Materials Co., Ltd., Sunpo Moulding (http://sunpomolding.com.cn), and Muehlmeier (https://www.muehlmeier.eu). Preferred foams have a thickness of from about 2 mm and greater. In some embodiment, foam thickness is up to about 3.5 cm. Thickness is referenced at a cup bust point for a push up or padded bra cup foam. Spacer cup scaffold materials, such as spacer pads made from spacer material, are available from spacer cup supplier, Mackent (https://www.mackent-group.com).

Thus, the moulded 3D bra cup of the invention wicks bodily fluid (e.g., sweat, breast milk or other breast fluid/discharge) away from a wearer's breast skin and into the bra cup assembly as described herein, thereby avoiding visible leaks of such fluid to external surfaces of the garment which remains dry even where leakages from the breast occur. Preferably, the moisture management moulded bra cup is also capable of supporting and/or lifting the breasts in a garment. Suitably, a preferred moulded bra cup comprises a breast/bra cup shaped scaffold component for providing support and/or lift to a user's breast when worn and/or enhances the fluid trapping ability of the core when the scaffold itself is a moisture/fluid absorbing material such as an open cell polyurethane foam. Due to the additional layers of construction of the assembly, preferred moulded 3D bra cups of the invention provide greater support and/or breast lift compared to an equivalent bra cup using the same scaffold component but without the moisture management components as described herein. The additional support and structure resulting from the fabric components of the moulded 3D bra cup advantageously enabling thinner and less rigid breast/bra cup shaped scaffold components to be used. Thinner scaffold components have advantageous manufacturing advantages including reduced cost, however depending on the need for additional fluid trapping ability in the core, thicker scaffolds, particularly absorbent foams may be preferred.

Suitably, the moulded 3D breast/bra cup shape adopts and retains a desired 3D shape on moulding. This shape is preferably retained during normal use which includes multiple wearing and laundering cycles. Suitably, the moulded 3D breast/bra cup shape is a seamless breast/bra cup that does not include stitching or the like, whereby adhesives are used to hold the assembly together. Desirably, after moulding, the moulded 3D breast/bra cup shape may have a hemispherical shape, a teardrop shape, a bullet shape, a bubble shape, a parabolic shape or a spherical/curved shape or any other shape useful for bra cup design/cutting. It will be understood that a moulded cup of the invention can be cut or trimmed to any particularly desired shape (e.g. Australian breast/bra cup size 10C to 18G or equivalent thereof) as required by a particular garment pattern. Prior to cutting, the moulded 3D breast/bra cup shaped assembly has a rounded bust portion corresponding to an area covering the nipple area of a wearer's breast. The 3D shape is in contrast to the precursor construct of layered fabric components which is a laminated flat (2D) component assembly prior to moulding.

Suitably, the moulded 3D breast/bra cup shaped assembly has an outer convex face and an inner concave face which directly contacts the wearer's breast skin when worn. In some embodiments, the outer convex face of the moulded bra cup comprises the moisture barrier component of the assembly. In other embodiments, the outer convex face of the moulded bra cup comprises the scaffold component of the assembly. If desired, the outer face of the moulded bra cup may be provided with an aesthetically pleasing additional fabric material, for example, Merino, cotton, bamboo blend, Modal™ (from Lenzing), lyocell, viscose, wool, cellulose derived, polyester, polyamide, nylon, acrylic, rayon, latex, or any blend thereof, such as a nylon/elastane blend, which, for example, may be laminated or otherwise bonded to the outer face, or may be stitched to the bra or bra cups, or it may form an outer layer of a garment comprising the bra cup of the invention. The additional fabric material may be treated, such as treated with a water repellent agent. Recycled and/or biodegradable and/or partly biodegradable or otherwise sustainable versions of these materials are preferred in some embodiments. In all embodiments, the inner concave face comprises the fluid wicking fabric component which is contactable with the wearer's breast skin during normal use. In use, the wearer's breast is accommodated within the concave portion of the moulded bra cup such that the fluid wicking fabric component is in direct contact with the wearer's breast skin. The positioning of the bra cup within the garment can be adjusted to provided more or less support and/or lift as required.

Suitably, one or more interlayers between each component comprise one or more adhesives or other suitable bonding agents. Preferably, the adhesive is provided such that it covers the entire surface area each of the components which are laminated. This may assist in ensuring each component is "entirely laminated" to a neighbouring component, meaning that that lamination is across the entire surface area or face of each component where it contacts the face of another component. This is important for avoiding delamination during normal wear and laundering. The adhesive may be provided in the form of a coating, layer or film, preferably a sprayed layer or film, a web or a tape of the adhesive. Some adhesives may be air activated or heat or pressure activated. The adhesives may be solvent-based, water-based or hot-melt adhesives. Suitably, the adhesives are selected from the group consisting of: oil adhesives, adhesive tapes, adhesive films, adhesive webs and the like. Suitable adhesive materials may be selected from polyurethane adhesives, hot melt adhesives such as vinyl acetate-ethylene copolymer adhesives, e.g., polyurethane, foam bra cup/fabric lamination adhesive #CG-1691Q-5) from Chemix (product available Guru Ltd (see https://adhesive.en-.taiwantrade.com/product/pu-foam-bra-cup-and-pu-fabric-lamination-adhesive-1937003.html), and spray adhesive glue for bra foam laminating (a vinyl acetate, ethylene copolymer available from Dongguan Four Dragon Enterprise Ltd (see https://silongglue.en.made-in-china.com/product/WsYnXZtMMNhK/China-Spray-Adhesive-Glue-for-Bra-Foam-Laminating.html).

Desirable adhesives comprise at least one thermoplastic, preferably an elastomeric thermoplastic such as polyurethane. In one embodiment, a polyurethane adhesive, for example, such as the oil based, one component polyurethane adhesive available under product description NEL-1050L can be advantageously used to provide strong, flexible and durable bonding/lamination and which can be readily sprayed both manually or by laminating machine. Other adhesives that are suitable for laminating fabric to foam may be used. Suitably, one or more of the adhesives do not degrade in the presence of water. Suitably, one or more of the adhesives are breathable adhesives. Breathable means air and moisture can pass through easily. In some embodiments, one or more of the adhesives are moisture permeable adhesives. Moisture permeable means the water and water vapour can diffuse through a film of the adhesive. In other embodiments, the adhesives are water proof adhesives. By water proof, it is meant the adhesive is impervious to water and thereby prevents permeation by water. Preferred adhesive are high temperature resistant (>150° C.) for moulding, for example, such as those available at https://silongglue.en-.made-in-china.com/product/ENHxYelJgCkb/China-Water-Based-Adhesive-Glue-for-Bra-Cup-Laminating.html. Preferred adhesive are high strength with good wash resistance, for example such as available at https://www.taiwantrade-.com/product/polyurethane-bra-cups-adhesives-cloth-glue-for-brassiere-lamination-1937203.html. Also, preferred is a polyurethane Spray Adhesive For Bra Foam Laminating from Chemix Guru (CG-1628D), see https://www.chemixguru.com/spray-adhesive-for-bra-foam-laminating/.

In some embodiments, the thickness of the adhesive coating, layer or film is about 1 mm or less, 0.75 mm or less, 0.5 mm or less or 0.25 mm or less.

In some embodiments, the one or more adhesives may to at least some degree interpenetrate fibres of one or more components of the moulded assembly, thereby improving the attachment of the components to each other on lamination. This is believed to reduce delamination from activities resulting from normal use, that is, wearing and/or laundering. It is believed that when the one or more adhesives are provided over the entirety of all surface areas of each component to be laminated, this enables the components of the moulded bra cup to be laminated or fused together in such a way as to avoid undesirable undulation, puckering or orange peel or orange skin effect during normal use including after washing. Observation of undulation, puckering or orange peel or orange skin effect signifies component delamination. Furthermore, delamination results in undesirable disruption or separation of the fabric layers of the laminate structure during use or during laundering which could lead to reduced performance or comfort.

In some embodiments, the fibres of one or more areas/regions of the fabric components after moulding are stretched into a more open structure compared to an equivalent component before moulding. This is particularly the case at the region at and around the bust point area of the cup which experiences the greatest stretching forces during moulding. Such stretching may be observed on microscopic examination of surfaces of a moulded assembly compared to an equivalent assembly or precursor construct which has not been subjected to the moulding process under consideration. The stretched/opened structure increases the gaps/spaces between the fibres of the fabric. This is a direct result of a moulding process involving thermoforming the fabrics while being stretched into, and retained as, a desired shape. Thermo forming involves subjecting the fabric to heat which causes a thermally induced reshaping of the fibres. It was expected that the stretching of fibres and accompanying opening of gaps of the moisture management assembly which occurs on moulding would detrimentally affect the moisture wicking and moisture retention properties of the assembly, particularly at the bust point part of the cup which contacts the nipple during use. Therefore, the excellent moisture management capability of the moulded bra cup of the invention was unexpected and surprising given this prejudice in the art. Likewise, it was expected that adhesive used to bond/laminate the entirety of the component layers together would adversely affect the moisture wicking and moisture retention properties of the assembly by interfering with wicking of fluid from the skin to the core element. Therefore, it was completely surprising that the moisture management moulded bra cup of the invention would function so well in terms of moisture management. Given the variation in the fabric of each of the components in the assembly, their different physical properties such as different materials, thicknesses, melting temperature, burn temperature, heat set temperature, shrinking properties, stretching properties, it was completely unexpected that aesthetically and functionally acceptable moisture management could be achieved for a moulded 3D bra cup. Another surprising benefit of the laminated, moulded, particularly thermo-moulded, bra cup as described herein includes that the multi-layer assembly retains its structure, including its structure without undulations, puckering, fabric bunching or creasing, upon repeated laundering. A further surprising benefit of the laminated, moulded, particularly thermo-moulded, bra cup as described herein includes that a precise shape and size is delivered to each component of the assembly simultaneously, which in particular, imparts a visibly smooth and homogenous finish to the innermost concave face of the breast-facing fluid wicking fabric component such that when the 3D breast/bra cup shaped laminated assemblies described herein are incorporated into a bra, the bra is more comfortable to wear for a user relative to a bra comprising cups having unlaminated components.

A preferred moulded bra cup of the invention has a total maximum thickness of between 1 mm and 10 mm, preferably of no more than 5 or 7 mm, most preferably of no more than 6 mm.

Suitably, a preferred moulded bra cup of the invention can manage volumes of bodily fluid up to and including 25 mL of the moulded bra cup, more preferably up to and including 40 ml of the moulded bra cup, more preferably up to and including 50 mL of the moulded bra cup without leaking. The maximum fluid absorbency capacity is one corresponding to the amount of fluid retained without visible leaking out of the moulded bra cup to the outside of the garment in which the bra cup is included. These maximum fluid absorbency capacities can be arrived at through a combination of selection of fabric of the core and/or the scaffold component as described herein, including gsm, number of layers of fabric in the core, etc. In one embodiment, these capacities can be achieved with a 240 gsm microfibre fabric as described herein.

Suitably, a preferred moulded bra cup of the invention can manage volumes of bodily fluid up to at least 30 mL of the moulded bra cup, more preferably at least 40 mL of the moulded bra cup, more preferably at least 50 mL of the moulded bra cup without leaking to the outside. These capacities are particularly preferred as they are associated with thinner moulded bra cups of thickness of about 10 mm or less.

In one embodiment, these volumes are associated with a moulded bra cup suitably sized for an Australian breast/bra cup size 10C to 18G or equivalent thereof. Higher bodily fluid capacities are associated with thicker moulded bra cups, while lower bodily fluid capacities are associated with thinner moulded bra cups.

A preferred moulded bra cup of the invention is air permeable and/or breathable. A preferred moulded bra cup of the invention is hand and/or machine washable. A preferred moulded bra cup of the invention has antimicrobial and/or odour minimising properties. One or more components of the moulded bra cup can comprise an odour elimination treatment such as one or more of Sciessent Lava XL and Agion. Furthermore, a preferred moulded bra cup solves the problem of odours arising from bodily fluids as well as keeping the wearer's skin dry. It will be understood that these treatments are optional and do not need to be included to benefit from the advantages of the invention. In some embodiments, these treatments are used in garments such as a breastfeeding bra, where breast milk is likely to be trapped in the moulded bra cups described herein. In some embodiments, these treatments do not need to be used in garments such as a sports bra, where sweat is likely to be trapped in the moulded bra cups described herein.

Suitably, the fabric composite comprises a fluid trapping core element for capturing, retaining and trapping bodily fluid wicked away from the wearer's skin. The moulded bra cup can wick bodily fluid away from a wearer's skin into a fluid trapping core element of the moulded bra cup. The fluid wicking component is directly contactable against the wearer's skin when a garment comprising the moulded bra cup is worn.

When used correctly and within its maximum capacity limits, the moulded 3D bra cup can prevent unwanted leaks of fluid from the fluid trapping core element onto the wearer's clothing.

Suitably, the assembly comprises a moisture barrier component which may be impenetrable to bodily fluid, may be bodily fluid resistant or bodily fluid repellent. Desirably, the moisture barrier component comprises a fabric material preferably an air breathable fabric treated with a moisture leakproof, moisture repellent or moisture resistant polymer, for example as a coating, layer, web, spray on the fabric, which prevents leaks onto the wearer's clothing. In some embodiments herein, where the moisture barrier component comprises a fabric material, this may be referred to as a moisture barrier fabric component. Suitably, under conditions required to laminate Merino, microfibre towel, polyurethane foam etc. the moisture barrier should not be a polyester laminated with polyurethane as this does not have a compatible softening, melting and/or burn point for the other materials used.

Various components as described herein may be selected and assembled together in a manner which supports bodily fluid management capability of volumes of at least 10 ml of the moulded bra cup and more as described above. Various components as described herein may be selected and assembled together in a manner which supports bodily fluid management capability of up to and including volumes of 30 ml of the moulded bra cup, more preferably up to and including volumes of 50 mL of the moulded bra cup. It will be understood that higher volumes are possible where larger cup sizes are used.

One or more of the components may include one or more hypoallergenic compounds. Suitably, one or more of the components may be pre-treated to enhance the hypo allergenicity thereof.

Preferably, the fluid wicking component comprises an absorbent or otherwise moisture wicking fabric, more preferably an absorbent, quick drying fabric. Preferably, the fabric of the fluid wicking component is moisture-wicking, or the fabric is pre-treated to enhance the moisture-absorbing and/or wicking capabilities thereof. A moisture-wicking fabric wicks bodily fluid from the interface between the fluid wicking component and the fluid trapping core element to a location deeper within the fluid trapping core element. Moisture wicking relies on "capillary action," involving the movement of the bodily fluid through tiny spaces within a fabric due to the molecular forces between the liquid and the fabric's internal surfaces. When fluid is absorbed into the fibres of the moisture-wicking fabric, the moisture gets wicked away to drier parts of the fibre of the fluid wicking component, for example, which are in direct fluid contact with the fluid trapping core element. Preferred moisture-wicking fabrics dry rapidly so that the bodily fluid may not easily saturate the fabric.

Preferably, the fluid wicking component comprises a fabric which is derived from a natural fibre or a synthetic fibre. In such embodiments, the fluid wicking component may be referred to as a fluid wicking fabric component. Natural fibres are preferred. Desirably, the fabric of the fluid wicking component may be hydrophilic or may comprise a hydrophilic material. Such materials may aid in wicking away bodily fluid away from the wearer's skin. Desirably, the fabric of the fluid wicking component may comprise keratinous fibres or other moisture-wicking or which are pre-treated to enhance the moisture-absorbing capabilities thereof. Preferred keratinous fibres are stain resistant. In some embodiments, the fluid wicking component comprises a fabric that has no pre-treatment. In some embodiments, optionally dyed but otherwise untreated natural keratinous fibres are used in the fluid wicking component. Otherwise, as desired, the fibres may be treated to render them stain resistant, with for example, Scotchguard™ or Teflon™.

Preferably, the fluid wicking component comprises a fabric comprising fibres selected from the group consisting of wool, preferably Merino wool, or a cellulosic material, which is preferably selected from the group consisting of moisture wicking synthetic materials including moisture wicking polyester, hemp, bamboo, cotton, silk and any combination or organic variation thereof. In one embodiment, when the fluid wicking component comprises a fabric comprising a cellulosic material, that cellulosic material is a semi-synthetic fabric. In some embodiments, the cellulosic material is a semi-synthetic rayon-based fabric. A preferred cellulose-based fabric is commercially available under the trade names Modal™ or Tencel™. In another embodiment, the fluid wicking component comprises a mesh, such as a polyester-based mesh. Suitable examples of mesh for use as a fluid wicking component will be known to those of skill in the art, but may include, for example, the polyester mesh product marketed as Coolmesh™.

Preferably, the fabric of the fluid wicking component is in the form of a knitted or a woven fabric, preferably knitted.

Preferably, the fluid wicking component includes an antimicrobial material or itself comprises fibres having antimicrobial properties, for example, such as wool, preferably a soft wool such as Merino wool. It will be understood that an antimicrobial material is one having antibacterial, antiviral, and/or antifungal properties. The antimicrobial property minimises, and more preferably eliminates, odour arising from the bodily fluid. Suitable antimicrobial materials include silver ions. Most preferably, the fabric of the fluid wicking component is in the form of a Merino wool.

Desirably, the fluid wicking component is included in a weight range of 50 gsm to 500 gsm in the fabric moulded bra cup. However, fluid wicking components in a weight in a range of 100 gsm to 350 gsm are preferred as less dense materials may feel more comfortable for the wearer. Fluid wicking components in a weight in a range of 125 gsm to 300 gsm are particularly preferred. In one embodiment, a fluid wicking component having a weight of 150 gsm to 200 gsm is preferred, and most preferably still, 180 or 190 gsm is preferred.

Desirably, the fluid wicking component has a thickness of between 0.5 mm and 5 mm, preferably of between 0.8 mm and 2 mm, most preferably ≤1 mm.

Suitably, the moulded bra cup assembly comprises a fluid trapping core element. The fluid trapping core element may comprise a single layer of fabric, dual layers of fabric or even multiple layers of fabric. The fabric may be the fluid trapping fabric component of the fluid trapping core element. The fluid trapping core element may include a fabric comprising absorbent fibres and/or absorbent compounds or materials such as a polymer gel which may be provided in fibre form. Most preferably the absorbent fabric is an absorbent and more preferably an absorbent and quick drying fabric. Desirably, the fluid trapping core element comprises a single layer of an absorbent fabric or material, preferably an absorbent, quick drying fabric, most preferably an absorbent, quick drying microfibre fabric. Alternatively, the fluid trapping core element may comprise two or more layers of an absorbent fabric or material, preferably an absorbent, quick drying fabric, most preferably an absorbent, quick drying microfibre fabric. Preferably, the two or more layers of absorbent fabric are laminated together. In one embodiment, the fluid trapping core element comprises two or more layers of absorbent fabric, an upper layer and one or more lower layers.

The fluid trapping core element may comprise one or more microfibre materials. The microfibre materials may form the fluid trapping fabric component of the fluid trapping core element. The fluid trapping core element may comprise one or more layers of an absorbent fabric, preferably an absorbent, quick drying fabric, more preferably an absorbent, quick drying microfibre fabric or woven or knitted fabric. A preferred absorbent fabric may include hydrophobic fibres, such as terry or towelling fabric, or may include bamboo or cotton towel. Preferred absorbent, quick drying fabrics may include hydrophobic, synthetic fibres. Absorbent, quick drying microfibre fabrics include a polyester microfiber (including recycled or biodegradable versions thereof), such as that commercially available under the trade name Zorb™. Recycled/biodegradable versions of these materials are preferably used. For example, recycled/bio-based/biodegradable yarn and blends of these is available from yarn supplier Fulgar, while recycled polyester yarn Regen® is available from yarn supplier Hyosung.

Preferably, the fluid trapping core element comprises one or more layers of an absorbent fabric, preferably an absorbent, quick drying fabric, more preferably an absorbent, quick drying microfibre fabric. The absorbent fabric may be the fluid trapping fabric component of the fluid trapping core element. Preferably the absorbent fabric is a wicking fabric such as a microfibre fabric, particularly a synthetic microfibre. Preferred fibres have a diameter of ≤10 microns. Suitable microfibre fabrics may comprise polyester or polyamides (nylon, or conjugation of polyester and polyamide). Recycled/biodegradable versions of these materials are preferably used. In one embodiment, the microfibre comprises a synthetic fabric which comprises a mixture of synthetic fibres, such as a polyester/polyamide or polyester/nylon fabric. Alternatively, the fluid trapping core element may be manufactured from a cellulosic material, such as hemp, bamboo, cotton or combination of these fibres. In some embodiments, the fluid trapping core element may be manufactured from a keratinous compound, such as wool. Insofar as possible it is preferred to use biodegradable and/or recycled versions of the parts, components and/or elements described herein. In some embodiments, biobased versions of the parts, components and/or elements described herein are used, which will be understood to mean plant and/or animal sources of primary materials used to manufacture the versions of the parts, components and/or elements described herein as opposed to fossil fuel sourced primary materials.

Desirably, the fluid trapping core element has a thickness of from 0.5 mm to 15 mm, preferably a thickness of from 1 mm to 10 mm, preferably from 1 mm to 5 mm, preferably from 1 mm to 3 mm, and preferably from 1 mm to 2 mm. In some embodiments, the fluid trapping fabric component of the fluid trapping core element has a thickness of from 0.5 mm to 15 mm, preferably a thickness of from 1 mm to 10 mm, preferably from 1 mm to 5 mm, preferably from 1 mm to 3 mm, and preferably from 1 mm to 2 mm. Depending on the desired level of bodily fluid management required, one or more fabric layers of the fluid trapping core element may comprise a denser or heavier fabric. For example, the fabric may be provided as a single layer of a fabric having a particular density or weight dictate the maximum bodily fluid absorption capacity of the fluid trapping core element. Alternatively, the core may be in the form of two or more individual layers of a fabric having a particular density or weight which in combination dictate the maximum bodily fluid absorption capacity of the fluid trapping core element. Suitably, where two are more layers of absorbent fabric are included, the two or more layers may be of the same absorbent fabric or material or different absorbent fabrics or materials. In some embodiments, where more than one fabric layer is used in the core, each layer may have the same density or weight or may have a different density or weight. A variety of different absorbent fabric layers which may of the same density or weight may be provided in the core. In a preferred embodiment, two or more layers of absorbent fabric may be provided in the core, particularly where a moulded bra cup having higher bodily fluid management capability is required. For example, where a single layer of absorbent fabric may accommodate up to 10 mL/cm$^2$ of the moulded bra cup of bodily fluid before saturation and leakage, two layers of that absorbent fabric may accommodate up to 25 mL of the moulded bra cup of bodily fluid before saturation and leakage. Likewise, three layers of that absorbent fabric may accommodate up to 30 mL of the moulded bra cup of bodily fluid before saturation and leakage, etc. It should be noted that there is a trade-off between the higher bodily fluid management capacity and the overall thickness of the fluid trapping core element. It will be understood that the thicker the fluid trapping core element, the less comfortable the moulded bra cup may be to wear. One layer of a wicking fabric of a sufficient density, weight and/or thickness, may be sufficient in terms of bodily fluid management and comfortable fit. In some embodiments, two or more layers of a wicking fabric of a sufficient density, weight and/or thickness, may be sufficient in terms of bodily fluid management and comfortable fit.

Desirably, the fluid trapping core element may comprise one or more layers of absorbent fabric, each layer of absorbent fabric having a weight range of 100 gsm to 500 gsm in the fabric moulded bra cup. The absorbent fabric may be the fluid trapping fabric component of the fluid trapping core element. However, a core in which each layer of absorbent fabric has a weight in a range of 100 gsm to 350 gsm are preferred, as less dense materials may be more comfortable for the wearer. In one embodiment, a preferred fluid wicking component has a fabric layer of a density or weight of 125 gsm to 300 gsm, more preferably 150 gsm to 300 gsm, most preferably 200 gsm to 300 gsm. Where higher bodily fluid management capability is required, it is preferred to use two or more layers of absorbent fabric with a lower gsm than a single layer of absorbent fabric with a higher gsm. For example, two fabric layers of 280 gsm would be preferred to a single fabric layer of absorbent fabric of 560 gsm. Most preferably still, a preferred fluid wicking component includes one or two layers of absorbent fabric each layer ideally having a fabric weight or density of 240 gsm, or 280 to 290 gsm. A single 240 gsm layer may be used where bodily fluid capacity of up to and including 25 ml of the moulded bra cup is required. A single 280 gsm layer may be used where higher bodily fluid capacity than 25 mL of the moulded bra cup is required. Desirably, in one or more of these arrangements, the bodily fluid capacity may be achievable with a total fabric moulded bra cup thickness of about 4-8 mm, preferably 6 mm. Two individual 280 to 290 gsm layers may be where even higher bodily fluid capacities of the moulded bra cup are required. Desirably, in one or more of these arrangements, the bodily fluid capacity may be achievable with a total fabric moulded bra cup thickness of about 1-1.4 mm, preferably about 1.2 mm.

As described above, in some embodiments, the fluid trapping core element is formed from a fluid trapping fabric component only. As described herein, such embodiments may be useful for applications where support and structure is not important, or is less important, than moisture absorbing capabilities. In some embodiments, a laminated assembly as described herein comprising a fluid trapping core element formed from a fluid trapping fabric component only sandwiched between a fluid wicking fabric component and a moisture barrier component may be laminated to a concave face (i.e., a face directed towards a wearer's breast in use) of a bra cup scaffold component, such as described above in the paragraph commencing from the line "Desirably, the bra cup support scaffold is a material selected from a foam, a spacer material, a mesh." Such embodiments may provide structure or support to a fabric-only core element design.

However, in other embodiments, as described elsewhere herein, the fluid trapping core element is formed from a fluid trapping fabric component and a fluid trapping bra cup scaffold component. In such embodiments, the fluid trapping fabric component is laminated to the fluid trapping bra cup scaffold component. As previously described, such embodiments may provide support, structure and maximum moisture management capability for applications such as maternity bras. The fluid trapping fabric component forming the fluid trapping core element in combination with the fluid trapping bra cup scaffold component may be the fabric, absorbent fabric and/or microfibre materials as described in the immediately preceding paragraphs commencing from the line "Suitably, the moulded bra cup assembly comprises a fluid trapping core element." The fluid trapping bra cup scaffold component may be as described elsewhere herein, particularly in the paragraph commencing from the line "Desirably, the bra cup support scaffold is a material selected from a foam, a spacer material, a mesh." As described herein, each of the fluid trapping fabric component and the fluid trapping bra cup scaffold component may individually comprise a single layer or may comprise multiple layers. When the fluid trapping core element is formed from a fluid trapping fabric component and a fluid trapping bra cup scaffold component, the fluid trapping fabric component and the fluid trapping bra cup scaffold component are laminated together, preferably laminated together such that a second face of the fluid trapping fabric component (i.e., a convex face directed away from a wearer's breast in use) is laminated to a first face of the fluid trapping bra cup scaffold component (i.e., a concave face directed towards a wearer's breast in use).

In yet further embodiments, as described elsewhere herein, the fluid trapping core element is formed from a fluid trapping bra cup scaffold component only. As described herein, such embodiments may be useful for applications where support and structure is somewhat important, but lower volumes of bodily fluid are involved, such as sweat. In such embodiments, the fluid trapping bra cup scaffold component may be as described elsewhere herein, particularly in the paragraph commencing from the line "Desirably, the bra cup support scaffold is a material selected from a foam, a spacer material, a mesh."

Suitably, the fabric composite of the invention comprises a moisture barrier component. Preferably, the moisture barrier component comprises a waterproof, water resistant or water repellent fabric or fabric treated to have such properties which prevents movement of bodily fluids from the fluid trapping core element to outside the moulded bra cup, thereby avoiding leakage of captured bodily fluid onto the wearer's clothing. Preferably, the moisture barrier component comprises a fabric which is itself waterproof, water resistant or water repellent. Desirably, the fabric may be treated with one or more agents for example, comprising hydrophobic polymers, such as polyethylene based hydrophobic polymers, hydrophobic non-fluorinated acrylic polymers, hydrophobic non-fluorinated urethanes, or bio-based or bio-derived hydrophobic polymers or compounds, (ideally not comprising or comprising only minimal fluorinated compounds such as PFOAs), which may assist with waterproofing, water resistance or water repellence. Suitable moisture barriers can comprise water proof, water repellent agents, compounds or compositions such as those available Huntsman or Rudolf. A preferred agent used to treat fabric to impart waterproof or water resistance or water repellancy include Aquapel™ by Nanotex which is a water repellent hydrocarbon based composition. Suitable moisture barrier films having inherent waterproofing or water resistance or water repellancy are available from Ding Zing. It will be understood that the terms "moisture" and "water" is used herein in the sense that it encompasses bodily fluids, particularly, sweat, breast milk and/or other breast discharge.

In one embodiment, the moisture barrier component may comprise a fabric which includes a coating, film or laminate of at least one water repellent, waterproof, or water resistant polymer. Suitably such moisture barrier polymer can be laminated, coated or sprayed onto, or otherwise associated with the fabric. For example, a film of polyurethane laminate makes the fabric moisture impenetrable. Suitable fabrics for association with a moisture barrier polymer include polyester, nylon, cotton, bamboo, cellulose fabric such as Tencel, or any knitted fabric. Semi-synthetic, biodegradable, biobased and/or recycled versions of these fabrics are particularly preferred. The barrier polymer renders the fabric of the moisture barrier component impenetrable, repellent or resistant to the bodily fluid trapped or captured within the core of the moulded bra cup assembly leaking through the barrier component to the outside of the garment in amounts that correspond to visually observable wetness (visible with the naked eye). For example, a film or laminate of polyurethane polymer or a polyurethane mixture may be provided on a one side of a polyester fabric to waterproof the polyester fabric. The treated side is then positioned facing the core. Other polyurethane polymer or polymer mix fabric composites comprising other fabrics can be used. For example, a polyurethane backing can be provided as a backing on nylon or cotton fabric.

Other suitable moisture barrier polymers include waterproof, water resistant and/or water repellent polymers such as silicon-based polymers including those available under the Huntsman or Rudolf brands (e.g. Hybridtex®). In other embodiments, a waterproof, water resistant and/or water repellent polymer or fabric tape or sheet could be used as laminate layer. The outer surface of the moisture barrier component fabrics ideally allows for air penetration, which may assist with drying the middle layers and ameliorating microbial growth and/or odours.

Preferably, the moisture barrier component is a polyester fabric treated with a moisture repellent substance, such as water proofing or water resistance agents from Aquapel, Huntsman or Rudolf. Desirably, the moisture barrier component is a biodegradable or recycled. Desirably, the moisture barrier component is formed from at least one breathable fabric. A breathable fabric is one which allows water vapour generated from evaporation of perspiration and water from the trapped bodily fluid to diffuse to the outside of the moulded bra cup. It will be understood that the water vapour is evaporated by the wearer's body heat.

Suitably, the moisture barrier component has a thickness in the range of between 0.1 mm and 2 mm, preferably between 0.2 mm and 1.5 mm. Typically, a preferred leakproof barrier component has a thickness of about 1 mm.

As used herein "laminated" or "fused" means the components are entirely welded, entirely bonded or otherwise entirely joined together. The term "leakproof" may be used interchangeably with the terms waterproof, moisture proof, bodily fluid proof, etc., and means that bodily fluid trapped in the fluid trapping core element does not traverse through the barrier component to the outside of the garment during normal use in amounts that correspond to at least those which correspond to visually observable wetness (that is, visible with the average naked eye). The term "water resistant" may be used interchangeably with the terms moisture resistant, bodily fluid resistant, etc., and means that bodily fluid trapped in the fluid trapping core element can only traverse through the barrier component to the outside of the garment during normal use in minor amounts that correspond to no, or minimal visually observable wetness (that is, visible with the average naked eye). The term "water repellent" may be used interchangeably with the terms moisture repellent, bodily fluid repellent, etc., and means that bodily fluid trapped in the fluid trapping core element are repelled from contacting the barrier component and traverse through the barrier component to the outside of the garment during normal use such that no, or only minor amounts that correspond to no, or minimal visually observable wetness (that is, visible with the average naked eye). For embodiments, acceptable functioning of "water proof", "water resistant" and "water repellent" properties depends on the volume of moisture/fluid held in the core whereby when the core is near or over capacity, the ability of the barrier component to function may be compromised. "Normal use" means where the moulded bra cup is used for bodily fluid management of volumes of at least 5 mL of the moulded bra cup, and in some embodiments, up to 50 mL of the moulded bra cup as described above.

In one embodiment, the fluid trapping core element may comprise a single layer of an absorbent fabric, preferably an absorbent, quick drying fabric, most preferably an absorbent, quick drying microfibre fabric. In embodiments comprising a fluid trapping core element comprising a single layer of an absorbent fabric, preferred core element fabric layers have a weight/density from 240 gsm to 350 gsm and a thickness of from about 1 mm to 2 mm. In such embodiments, preferred moulded bra cups have a maximum thickness of from 2 to 30 mm through the bust point of the moulded bra cup. In such embodiments, preferred moulded bra cups have a maximum thickness of 5 to 15 mm through the bust point of the moulded bra cup.

In a preferred embodiment, the fluid trapping fabric component comprises a laminate structure including two or more layers of an absorbent fabric, preferably an absorbent, quick drying fabric, most preferably an absorbent, quick drying microfibre fabric. For example, where two layers of absorbent fabric are used, that is, a lower layer and an upper layer of absorbent fabric. Inclusion of more than one layer of absorbent fabric in the fluid trapping core element dramatically increases the moisture management capabilities of the moulded bra cup.

In a preferred embodiment, the bra cup comprises a moulded 3D breast/bra cup shaped fabric assembly comprising: a Merino wool fluid wicking component for wicking bodily fluid from a wearer's skin and having a first face contactable against the wearer's skin and a second face laminated to a first face of a polyester or a polyester polyamide blended microfibre fluid trapping fabric component for protecting the garment from fluid leaks by trapping wicked bodily fluid therein, wherein a second face of the polyester or a polyester polyamide blended microfibre fluid trapping fabric component is laminated to a first face of a polyurethane foam breast shaped cup scaffold for supporting a wearer's breast, wherein a second face of the polyurethane foam breast shaped cup scaffold is laminated to a first side of polyester based moisture barrier polymer treated fabric component, wherein an outer face of the polyester moisture polymer treated barrier fabric component faces away from the wearer's skin, wherein each component is set into a moulded 3D breast/bra cup shape.

In a particularly preferred embodiment, there is provided a moisture management moulded bra cup for supporting breasts in a garment and for wicking bodily fluid away from a wearer's skin into a fluid trapping core element of the moulded 3D breast/bra cup, the moulded 3D breast/bra cup comprising:

- a polyurethane foam bra cup scaffold having an outer convex face and an inner concave face having laminated thereon the inner concave face as a moulded assembly:
- the fluid trapping core element being at least one layer of a polyester microfibre sandwiched between a fluid wicking component being Merino wool contactable against the wearer's skin and a leakproof barrier component being a polyester based moisture barrier in the form of a polymer treated polyester fabric component for protecting the garment from fluid leaks from the fluid trapping core element, the polyester based moisture barrier polymer treated polyester fabric component contacting the inner concave face of the foam bra cup scaffold,
- wherein the fluid trapping core element is bonded to the polyester based moisture barrier polymer treated fabric component which in conjunction with the polyester based moisture barrier polymer treated fabric component retains trapped bodily fluid in the fluid trapping core element.

Suitably, the components are laminated or otherwise fused together. Desirably, one or more interlayers between each component comprise one or more laminating breathable, moisture permeable adhesives. Suitably, the entire surface area of each of the components are fused or laminated together.

Also described herein is a garment having included therein a moulded bra cup of the invention as described herein. Preferably, the moulded bra cup forms part of a garment, for example, underwear, a bra, a maternity bra, a singlet, a t-shirt, a sports bra. Advantageously, the moulded bra cup of the invention may be included in the cup region of a bra (e.g., a sports bra or a maternity bra). Suitably, the moulded bra cup may be non-removably attached to the garment, preferably wherein the moulded bra cup is sewn or bonded to the garment. For example, an assembled moulded bra cup may be bonded or sewn into the outer fabric to make the garment, e.g., breast pad for bra or maternity tops. Alternatively, the moulded bra cup may be removably attached to the garment, preferably wherein the moulded bra cup retained in the garment by, for example, Velcro™ or press studs, or by insertion through a pocket in the liner, e.g., as removable pads in sports bras). Suitably, the moulded bra cup may be affixed or attached to the garment in, proximal to, substantially covering, or extending over, at least part of a bodily fluid discharge zone. It will be understood that, in use, the fluid wicking component is proximal to the body of a wearer, while the moisture barrier component is distal from a wearer's skin. In use, the moulded bra cup may be fixed or attached to the garment in, proximal to, substantially covering, or extending over, at least part of a breast. The bra cup may form part of a garment, particularly an undergarment, and as such may be non-removably attached to the undergarment. As such, the protective moulded bra cup may be sewn or bonded to the garment. In one embodiment, the moulded bra cups described herein are an integral part of a bra and for example may be attached to a bra cradle. In such embodiments, the moulded bra cups described herein are not only not detachable from the bra of which they form a part but are the only bra cups of the bra. In some embodiments, the bra is a launderable bra and comprises moulded 3D bra cups as described herein, such as two moulded 3D bra cups as described herein. Each moulded 3D bra cup preferably comprises a laminated assembly as described herein. Suitably the bra cups may sit in a bra cradle. Preferably the bra cradle comprises moisture management capability and for example may comprise the same or a different assembly of fabrics as the bra cup. The bra cradle may not be thermo-moulded. For example, the cradle may comprise a fluid wicking layer laminated to a fluid trapping core which is laminated to a moisture barrier component, each preferably as described herein in detail. When in the form of a brassiere, singlet, sports bra, or T-shirt, the protective moulded bra cup may be attached to the clothing in the general chest area of a user, the underarm area, or both. In use, the fluid wicking component is positioned proximal to, and contacting the skin of a wearer, while the moisture barrier component is then positioned distally or furthest from a wearer's skin. During normal use (meaning when worn against a wearer's skin), the fluid wicking component is directly contactable against a wearer's body when the garment is worn. The moisture-wicking fabric wicks bodily fluid away from the wearer's skin to the fluid trapping core element which traps the wicked body fluid within the moulded bra cup, thereby keeping the fluid wicking component dry to touch, even when the cup is supporting a breast, at least until the maximum volume capacity of the moulded bra cup is reached. The skin contacting surface of the wicking layer component is kept dry to the touch at least when the moulded bra cup is used as intended, i.e., to supports bodily fluid management capability of greater than 5 mL, more preferably greater than 25 mL, more preferably greater than 30 mL and most preferably up to 50 mL of bodily fluid.

The invention further extends to a method of manufacturing a flat (2D) moisture management moulded bra cup precursor construct for forming a moisture management moulded (3D) bra cup as described herein. The method comprises the steps of: fusing or laminating a moisture barrier fabric component to a scaffold component to form a first subassembly; fusing or laminating a fluid trapping core element over the scaffold component of the first subassembly thereby forming a second subassembly; laminating a fluid wicking fabric component over the fluid trapping core element of the second subassembly to form a flat (2D) precursor construct for moulding. In one embodiment, the method comprises the steps of: fusing or laminating a moisture barrier fabric component to a fluid trapping bra cup scaffold component to form a first subassembly; fusing or laminating a fluid trapping fabric component over the fluid trapping bra scaffold component of the first subassembly, thereby forming a second subassembly; laminating a fluid wicking fabric component over the fluid trapping fabric component of the second subassembly to form a flat (2D) precursor construct for moulding. In another embodiment, the method comprises the steps of: fusing or laminating a moisture barrier fabric component to a fluid trapping bra cup scaffold component to form a first subassembly; and, laminating a fluid wicking fabric component over the fluid trapping bra scaffold component of the first subassembly to form a flat (2D) precursor construct for moulding. In yet another embodiment, the method comprises the steps of: fusing or laminating a moisture barrier fabric component to a fluid trapping fabric component, thereby forming a first subassembly; laminating a fluid wicking fabric component over the fluid trapping fabric component of the first subassembly to form a flat (2D) precursor construct for moulding. In yet a further embodiment, the method comprises the steps of: fusing or laminating a bra scaffold component to a moisture barrier fabric component, thereby forming a first subassembly; laminating a fluid trapping fabric component to the moisture barrier fabric component of the first subassembly, thereby forming a second subassembly; laminating a fluid wicking fabric component over the fluid trapping fabric component of the second subassembly to form a flat (2D) precursor construct for moulding. The flat 2D precursor construct as described in this paragraph may suitably be used to construct other parts of a garment, such as a bra, including the central gore and/or side cradle portions of the bra, if desired. If used for the central gore and/or side cradle portions of a bra, the flat 2D precursor construct as described in this paragraph may be described as a non-moulded laminated construct, since it will be understood that moulding may not generally be required for these parts of the bra. In one embodiment, however, it will be understood that the flat 2D precursor as defined in this paragraph may be moulded in a single piece to form a combined side cradle, bra cup and central gore assembly for use as a bra. In another embodiment, the flat 2D precursor as defined in this paragraph may be moulded in a single piece to form a combined side cradle and bra cup assembly for use in a bra. In another embodiment, the flat 2D precursor as defined in this paragraph may be moulded in a single piece to form a combined central gore and bra cup assembly for use in a bra.

In some embodiments, the laminated precursor construct described herein may be used in non-moulded parts of a garment, such as the central gore and side cradle areas of a bra. In one embodiment, the laminated precursor construct described herein is used in non-moulded parts of a bra comprising moulded 3D bra cups according to the description herein. In one embodiment, a bra comprising moulded 3D bra cups as described herein further comprises a central gore and side cradle areas formed from a laminated precursor construct described herein. In one embodiment, a bra, such as a launderable bra, is provided comprising two moisture management moulded 3D bra cups for supporting breasts, wherein each bra cup comprises a thermomoulded 3D breast/bra cup shaped laminated assembly comprising parts as follows: a fluid wicking fabric component for wicking bodily fluid from a wearer's skin and having a first face contactable against the wearer's skin during normal use and having a second face laminated to a first face of a fluid trapping core element for protecting the garment from fluid leaks by trapping wicked bodily fluid therein, wherein a second face of the fluid trapping core element is laminated to a first side of a moisture barrier component, wherein an outer face of the moisture barrier component faces away from the wearer's breast skin during normal use, wherein each part in the assembly adopts a thermomoulded 3D breast/bra cup shape, wherein the moisture management moulded 3D bra cups are integrated into the bra, and wherein the bra further comprises a central gore and or one or more side cradles comprising a non-moulded laminated construct comprising a moisture wicking fabric component laminated to a fluid trapping bra cup scaffold component. In this embodiment, the fabric wicking component of the gore and/or one or more side cradles is innermost to the body when the bra is in use, i.e., contacts the skin of a wearer, and the fluid trapping bra cup scaffold component is outer facing when the bra is in use, i.e., is positioned away from the skin of a wearer. In another embodiment, a bra, such as a launderable bra, is provided comprising two moisture management moulded 3D bra cups for supporting breasts, wherein each bra cup comprises a thermomoulded 3D breast/bra cup shaped laminated assembly comprising parts as follows: a fluid wicking fabric component and having a first face contactable against the wearer's skin during normal use and having a second face laminated to a first face of a fluid trapping bra cup scaffold component, wherein a second face of the fluid trapping bra cup scaffold component is laminated to a first side of a moisture barrier component, wherein an outer face of the moisture barrier component faces away from the wearer's breast skin during normal use, wherein each part in the assembly adopts a thermomoulded 3D breast/bra cup shape, wherein the moisture management moulded 3D bra cups are integrated into the bra, and wherein the bra further comprises a central gore and two side cradles comprising a non-moulded laminated construct comprising a body-facing moisture wicking fabric component, preferably wool, more preferably Merino wool, laminated to an externally facing fluid trapping bra cup scaffold component, preferably foam, more preferably a polyurethane foam optionally comprising a proportion of biodegradable material.

In a further embodiment, a bra, such as a launderable bra, is provided comprising two moisture management moulded 3D bra cups for supporting breasts, wherein each bra cup comprises a thermomoulded 3D breast/bra cup shaped laminated assembly comprising parts as follows: a fluid wicking fabric component for wicking bodily fluid from a wearer's skin and having a first face contactable against the wearer's skin during normal use and having a second face laminated to a first face of a fluid trapping core element for protecting the garment from fluid leaks by trapping wicked bodily fluid therein, wherein a second face of the fluid trapping core element is laminated to a first side of a moisture barrier component, wherein an outer face of the moisture barrier component faces away from the wearer's breast skin during normal use, wherein each part in the assembly adopts a thermomoulded 3D breast/bra cup shape, wherein the moisture management moulded 3D bra cups are integrated into the bra, and wherein the bra further comprises a central gore and or one or more side cradles comprising a non-moulded laminated construct comprising a fluid trapping bra cup scaffold component laminated to and sandwiched between a moisture wicking fabric component and a moisture barrier component. In this embodiment, the fabric wicking component of the gore and/or one or more side cradles is innermost to the body when the bra is in use, i.e., contacts the skin of a wearer, and the moisture barrier component is outer facing when the bra is in use, i.e., is positioned away from the skin of a wearer. In another embodiment, a bra, such as a launderable bra, is provided comprising two moisture management moulded 3D bra cups for supporting breasts, wherein each bra cup comprises a thermomoulded 3D breast/bra cup shaped laminated assembly comprising parts as follows: a fluid wicking fabric component and having a first face contactable against the wearer's skin during normal use and having a second face laminated to a first face of a fluid trapping bra cup scaffold component, wherein a second face of the fluid trapping bra cup scaffold component is laminated to a first side of a moisture barrier component, wherein an outer face of the moisture barrier component faces away from the wearer's breast skin during normal use, wherein each part in the assembly adopts a thermomoulded 3D breast/bra cup shape, wherein the moisture management moulded 3D bra cups are integrated into the bra, and wherein the bra further comprises a central gore and two side cradles comprising a non-moulded laminated construct comprising a body-facing moisture wicking fabric component, preferably wool, more preferably Merino wool, laminated to a fluid trapping bra cup scaffold component, preferably a foam, more preferably a polyurethane foam optionally comprising a proportion of biodegradable material, which is in turn laminated to an externally facing moisture barrier component, preferably a water-resistant fabric, more preferably a treated polyester and in particular a recycled polyester. The side cradles may be attached to the bra by any suitable means known in the art, but advantageously are attached to the bra cups described herein forming part of the bra using self-fabric binding, optionally using twin needle stitching of self-fabric binding. Self-fabric binding, preferably Merino wool self-fabric binding, advantageously provides a level of moisture wicking and moisture absorbing functionality to the seam in addition to the cups and the side cradles. In other embodiments, as described above, the side cradles may be integral with one or more bra cup(s) in a single laminated assembly.

The invention also extends to a precursor construct ready for moulding into an assembly as described herein, the precursor construct comprising: a fluid wicking fabric component for wicking bodily fluid from a wearer's skin and having a first face contactable against the wearer's skin and a second face fused or laminated to a first face of a fluid trapping core element for protecting the garment from fluid leaks by trapping wicked bodily fluid therein, wherein a second face of the fluid trapping core element is fused or laminated to a first face of a bra cup scaffold component for supporting a wearer's breast, wherein a second face of the bra cup scaffold component is laminated to a first side of a moisture barrier fabric component.

In a related aspect there is provided a method of manufacturing a moisture management moulded bra cup comprising the steps of: laminating a moisture barrier fabric component to a fluid trapping core element over to form a second flat (2D) subassembly; laminating a fluid wicking fabric component over the fluid trapping core element of the second subassembly to form a flat (2D) precursor construct; moulding the flat (2D) precursor construct into a moulded 3D breast/bra cup shaped assembly such that the fluid wicking component forms an inner concave face of the moulded 3D breast/bra cup for contacting skin and the moisture barrier fabric component forms an outer convex face of the moulded 3D breast/bra cup.

Suitably, the fluid trapping core element comprises one or more of a fluid trapping fabric component and a bra cup scaffold component for supporting a wearer's breast and providing structure to the assembly. In embodiments where the bra cup scaffold comprises a fluid trapping material such as a foam, the scaffold can contribute to the core's fluid trapping function.

In another aspect, the invention extends to a method of manufacturing a moisture management moulded bra cup as described herein, comprising the steps of: laminating a moisture barrier fabric component to a scaffold component to form a first subassembly; laminating a fluid trapping core element over the scaffold component of the first subassembly thereby forming a second subassembly; laminating a fluid wicking fabric component over the fluid trapping core element of the second subassembly to form a flat (2D) assembly; and moulding the flat (2D) assembly into a moulded 3D breast/bra cup shaped assembly such that the fluid wicking component forms an inner concave face of the moulded 3D breast/bra cup for contacting skin and the moisture barrier fabric component forms an outer convex face of the moulded 3D breast/bra cup.

In another embodiment, the invention provides a method of manufacturing a moisture management moulded bra cup as described herein, comprises the steps of:

(i) layering components as follows: providing a fluid wicking fabric component as a first layer, providing a fluid trapping core element as a second layer overlaying the first layer, providing a bra cup scaffold component as a third layer over the second layer, and a moisture barrier fabric component as a fourth layer overlaying the third layer, to form a flat (2D) layered construct;

(ii) laminating the layered construct to form a laminated precursor construct which is mouldable into a desired 3D shape.

In some embodiments, the laminated precursor construct may be used in non-moulded parts of a garment, such as the central gore and side cradle areas of a bra.

In another aspect, the invention provides a method of manufacturing a moisture management moulded bra cup as described herein, comprising the steps of:

(i) layering components by providing a fluid wicking fabric component as a first layer, a fluid trapping core element as a second layer over the first layer, a bra cup scaffold component as a third layer over the second layer, and a moisture barrier fabric component as a fourth layer over the third layer, thereby forming a flat (2D) layered construct;

(ii) laminating the layered components to form a laminated precursor construct for moulding into a desired shape.

In another aspect, the invention provides a method of manufacturing a moisture management moulded bra cup for supporting breasts in a garment and for wicking bodily fluid away from a wearer's skin, the method comprising:

sandwiching a fluid trapping core element between a moisture barrier component and a fluid wicking component wherein the sandwiching step further comprises providing one or more adhesives between the fluid trapping core element and the moisture barrier component;

laminating the components together to form a flat (2D) laminated assembly;

overlaying a flat (2D) breast/bra cup scaffold component over the flat (2D) laminated assembly such that the moisture barrier component of the flat (2D) laminated assembly contacts the bra cup scaffold component, and providing one or more adhesives between the flat (2D) bra cup scaffold component and the moisture barrier component of the flat (2D) laminated assembly to form a flat (2D) precursor composite for moulding;

thermoforming a moulded 3D breast/bra cup by positioning the fluid wicking component of the precursor composite directly onto a breast/bra cup shaped mould and stretching and heating the composite over the breast/bra cup shaped mould.

In another aspect, the invention provides a method of manufacturing a moisture management moulded bra cup for supporting breasts in a garment and for wicking bodily fluid away from a wearer's skin, the method comprising sandwiching a fluid trapping core element between a moisture barrier component and a fluid wicking component wherein the sandwiching step further comprises providing one or more laminating adhesives between the fluid trapping core element and the moisture barrier component;

laminating the components together to form a flat (2D) laminated assembly;

overlaying a flat (2D) breast/bra cup scaffold component with the flat (2D) laminated assembly such that the leakproof barrier component of the flat (2D) laminated assembly contacts the bra cup scaffold component and providing one or more adhesives between the flat (2D) breast/bra cup scaffold component and the moisture barrier component of the flat (2D) laminated assembly to form a precursor composite for moulding;

forming the moulded 3D breast/bra cup by positioning the fluid wicking component of the composite directly onto a breast/bra cup shaped mould and stretching, heating and compressing the composite over the breast/bra cup shaped mould. During moulding, compression is greatest at the cup apex area and the base of cup area. This results in the assembly being much thinner at these points than at the bust point region of the cup.

The described methods may further comprise the steps of applying one or more adhesives between each of the component layers prior to lamination to form a flat (2D) laminated assembly. The adhesives may be provided as a coating or layer, applied by a blade or sprayed, over the entire surface of each component. Suitably, the adhesive is in the form of a liquid adhesive which is a sprayed layer of adhesive between each component.

Suitable components, adhesives and conditions have been described above and are believed to aid in fusing the entirety of each component's face to that of the neighbouring component. Suitably, the lamination is carried out using a laminating machine. Preferred laminating machines have inbuilt adhesive spraying capability. Examples of suitable machines include a KUNTAI machine (see https://www.alibaba.com/product-detail/fabric-to-foam-laminating-machine-for_60804922631.html) or a laminating machine from SHANTOU YILI MACHINE EQUIPMENT CO., LTD or a laminating machine such as a YL 2000 PUR HOT MELT LAMINATING MACHINE (see https://www.youtube.com/watch?v=tH59gfGyr74) or NEW PADS INDUSTRY CO., LTD laminating machine, DM-021-SPRAY-DB Laminating Machine (see http://www.newpads.com.tw/en/product-350374/Spray-laminating-machine-DM-021-SPRAY-DBLaminating-Machine.html).

Suitably, the moulding step involves moulding the flat (2D) precursor construct as described herein over a breast/bra cup shaped mould for a period of time sufficient allowing the construct to adopt the shape of the breast shaped mould in the form of the moulded 3D breast/bra cup shaped fabric assembly as described herein. Desirably, the moulding is compression moulding and/or thermo moulding, such as bullet or bubble moulding. Thermo moulding as described herein may comprise thermocompression. Suitably, the moulding is carried out using a bullet or bubble moulding machine, such as bra cup machines available from SHANTOU YILI MACHINE EQUIPMENT CO., LTD, MACHINE NAME: KV-168A/F-113 Luxury Design Big Platform Bra Cup Molding Machine, (See https://bracupmachine.en.alibaba.com/product/689948776-221319305/KV_168 A_F_113_Luxury_Design_Big_Platform_Bra_Cup_Molding_Machine.html?spm=a2700.shop_index.82.9.46572b30krQVnl), BRAND NAME: NEW PADS INDUSTRY CO., LTD MACHINE NAME: DM-021HP-4PR Bra Cup Machine, (see http://www.newpads.com.tw/en/product-c63237/Bra-Cup-Machine.html), SHANTOU HONGJI MACHINE EQUIPMENT CO., LTD MACHINE NAME: KV-168A/F-0 Bra Cup Molding Machine, see (https://bracupmachine.en.alibaba.com/product/689933775-221319305/KV_168 A_F_0_Bra_Cup_Molding_Machine_Foam_Bra_Pad_Molding_Machines.html?spm=a2700.shop_pl.41413.37.19fe7da7XGPtmm).

Suitably, on moulding, the flat (2D) precursor acquires or adopts a desired 3D moulded shape as a result of subjecting a moisture management moulded bra cup precursor construct as described herein to a moulding process as described herein, such as a compression and/or thermo moulding process, for example, bullet or bubble moulding over a bullet shaped or bubble shaped biting mould comprising biting male and female parts. Suitably, on moulding and setting, the assembly adopts a moulded shape which is a bra cup shape as described herein. Suitably, the method further comprises the step of: moulding the laminated precursor construct into a desired 3D shape. Desirably, the moulding step involves compression and/or thermo moulding of the precursor construct, for example, via bullet moulding or bubble moulding, suitably using a bullet or bra cup shape mould. Preferable the 3D shape is a bra cup shape, most preferably a seamless bra cup shape. The moulds can be teardrop shaped, hemispherical shape for example.

Desirably, after moulding into the desired 3D bra cup shape, at least one portion of the moulded 3D breast/bra cup shaped fabric assembly is stretched or deformed compared to an equivalent precursor construct that has not been subjected to the same moulding process. In some embodiment, the fabric in the region of the bust point region of the moulded fabric assembly may be particularly stretched or deformed as evidenced by the presence of larger gaps between the fibres and/or stretched fibres compared to a non-moulded construct. Such differences may be confirmed microscopically.

In some embodiments, the components of the assembly may be laminated together through fusion of opposing contacting faces of each component together. Suitably, one or more interlayers, that is spaces, between each component of the assembly comprise one or more adhesives aid in lamination of one face of one component to one face of another component. Desirably, each component is "entirely laminated" to a neighbouring component, meaning that that lamination is across the entire surface area or face of each component where it contacts another component.

Preferably, one or more adhesives are provided in interlayers between each component. Suitably, the adhesive is a liquid adhesive which may be applied onto each layer during layering, for example, by spraying. Suitably, the adhesive is applied over the entire surface of each component to be contacted by another component such that on lamination the entire component face of a component contacting a neighbouring component face is laminated. Suitable adhesives and various components have discussed elsewhere herein.

Suitably the method further comprises the step of: moulding the laminated flat (2D) precursor construct into a desired moulded 3D shape. Desirably, the moulding step involves compression and/or thermo moulding of the laminated flat (2D) precursor construct, for example, via bullet moulding or bubble moulding. Preferably the 3D shape is a bra cup shape, most preferably a seamless bra cup shape. Suitably, the precursor construct is heated and compressed over the bra/breast/bra cup shaped mould for a period of time sufficient so as to cause the precursor construct to adopt the 3D shape of the bra/breast shaped mould. After moulding, the fluid wicking component forms a concave face of the moulded 3D breast/bra cup for contacting skin and the moisture barrier component forms a convex face of the moulded 3D breast/bra cup. It will be understood for a 3D mould comprising a male bullet shaped convex part and a female concave part, moulding involves the flat 2D precursor between male and female moulding parts using a suitable bra cup moulding machine and compressing or biting the parts together while applying heat. The fluid wicking component is placed face down on top of the male convex part of the mould. Desirably, the breast/bra cup shaped mould is formed of a heat conducting material such as aluminium or other suitable metal or heat conducting material.

Preferably, the forming or moulding step comprises heating the precursor construct over the mould at a temperature of from about 90° C. to about 220° C., more preferably from about 170° C. to about 190° C., most preferably about 180° C. The temperatures selected depend on the components used, compatibility of their properties and component thicknesses, but determining optimum temperatures, laminating compatibility and compression timings is not difficult as samples can be prepared, tested and subjected to quality control very quickly. Suitably, heat is applied for a period of from about 100 to 250 seconds, and in some embodiments, such as the specific embodiment described herein, preferably from about 150 to 200 seconds. In some embodiments, such as the specific embodiment described herein, applying heat for about 170 seconds provides good results.

Desirably, the moisture management fabric moulded bra cup manufactured is of a moulded bra cup as described herein. Also described herein is a moisture management moulded fabric for a breast portion of a garment for supporting breasts and for wicking bodily fluid away from a wearer's skin, obtainable by a method as described herein.

Description of Preferred Embodiments

FIG. 1(*a*) shows a schematic drawing illustrating an exploded view of a preferred embodiment of a flat 2D precursor construct 101 (pre moulding) for fabricating moulded 3D bra cup of the invention. The view illustrates the positioning and ordering of the component layers. In this embodiment, a Merino fluid wicking layer 1 is overlayed by a single microfibre terry layer 2 (fluid trapping core), which is itself overlayed by a polyurethane foam scaffold 3, which is then overlayed by a water repellent polyester 4 which corresponding to the moisture barrier component of the assembly. In this embodiment, the fluid trapping core element C comprises the combination of the microfibre terry layer 2 (fluid trapping fabric component and polyurethane foam 3 (bra cup scaffold component). As explained elsewhere herein, the fluid trapping core element C can comprise fluid trapping fabric component only, a fluid trapping scaffold component only, or most preferably a combination of fluid trapping fabric component and fluid trapping scaffold component as a preferred configuration shown in FIG. 1(*a*). The adhesive film, layer or coating provided between each layer (or in the interlayer areas between the components) for fusion or lamination in not shown in this schematic for simplicity. FIG. 1(*b*) shows the laminated precursor construct ready for fabrication into a preferred moulded 3D bra cup of the invention.

Figure 2:
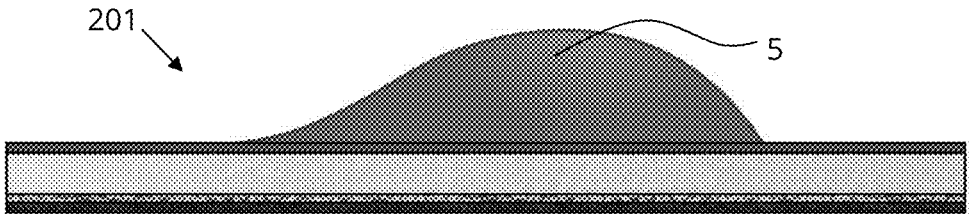
FIG. 2 is a schematic drawing illustrating a side view of a preferred embodiment of a moulded bra cup of the invention prior to cutting.

FIG. 2 is a schematic drawing illustrating a side view of a preferred embodiment of a moulded 3D bra cup 201 of the invention prior to cutting. The 3D cup shape 5 resulting from the moulding process is evident from this drawing whereby the water repellent polyester 4 forms the concave (outer) face of the moulded bra cup of the invention. In this drawing the 3D shape is teardrop shape which can be readily altered using a different shape mould during the moulding process.

Figure 3:
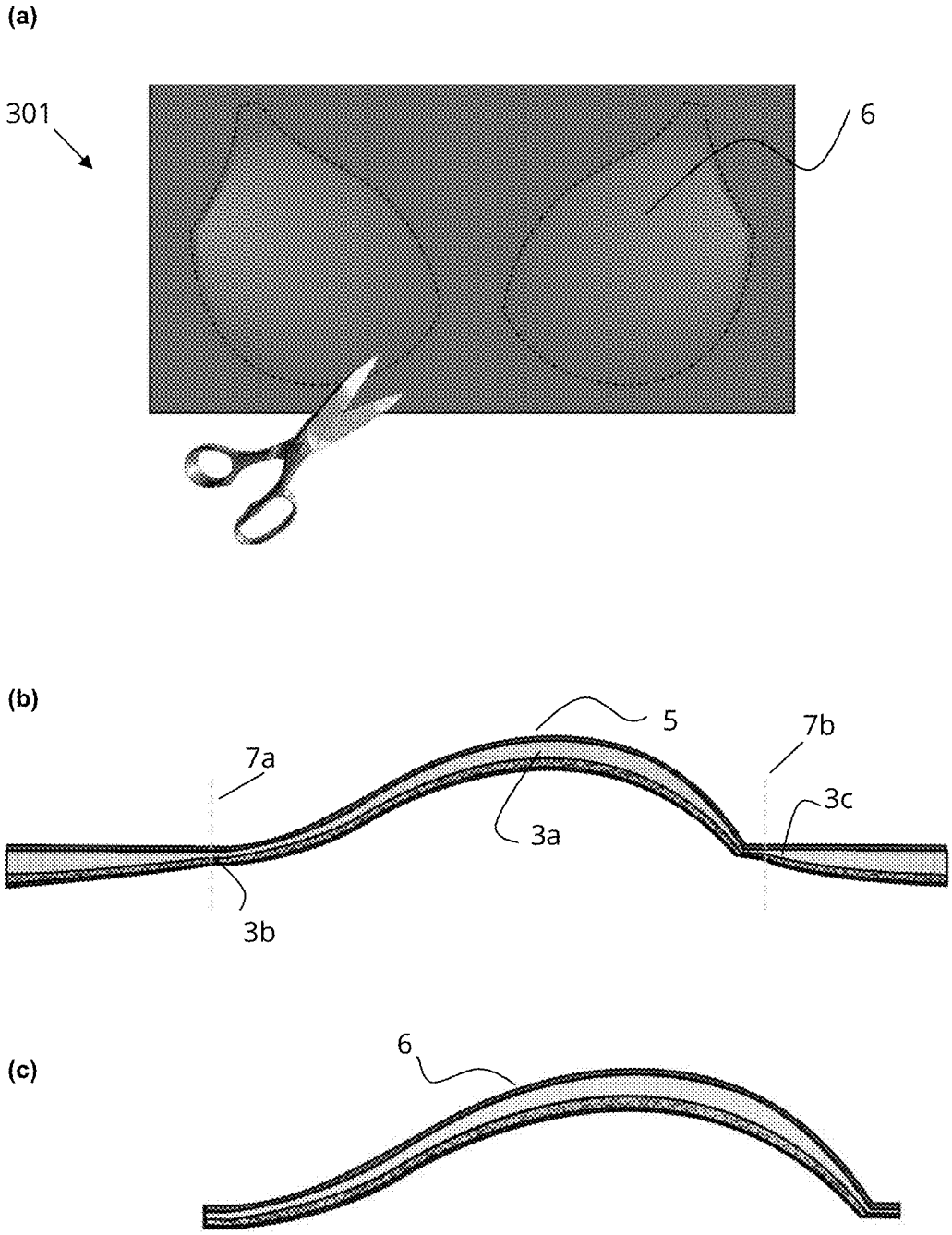
FIG. 3 is a schematic drawing illustrating (a) cutting pattern for bra cups of one embodiment of the invention; (b) a cross section view of a preferred embodiment of a moulded bra cup of the invention prior to cutting; (c) a cross section view of a preferred embodiment of a moulded bra cup of the invention after cutting.

FIG. 3(*a*) is a schematic drawing illustrating (a) cutting pattern for bra cups of one embodiment of the invention. FIG. 3(*b*) illustrates a cross section view of a preferred embodiment of a moulded bra cup of the invention prior to cutting. The effect of the variable degrees of compression experienced during moulding of the precursor assembly is evident in this depiction. During moulding, compression is greatest evenly around all outer edges of the cup. This results in the assembly being much thinner at these points than at the bust point region 3*a* of the cup which the compression is less than at the peripheral edges. At areas of compression, the scaffold material is also compressed at these locations. It is also evident that the foam at the bust point of the cup has the greatest thickness as it is subjected to the least compression (though greatest stretching) in the mould. This is useful at the bust point where leakage from the nipple occurs. Parts of the precursor (exemplified by area 3*c*) not subjected to the moulding process remain as they were in the laminated flat 2D precursor.

In the example of FIGS. 1 to 3, preferred component materials are as follows: Fluid Wicking Component: Merino wool: 1 mm thickness, 190 gsm density (supplier: Diyang Merino Textile Ltd); Fluid trapping core fabric: polyester/polyamide (80/20) microfibre 2 mm thickness, 240 gsm density (supplier: Suzhou Yiguan Textile., Ltd); Scaffold component: polyurethane foam: 8 mm thickness (pre-moulding), 30 kg/m$^3$ density (supplier: Guangzhou Seal-Beauty Bra Cup Co. Ltd) (http://www.sealbra-cup.com); Moisture barrier component: water repellent polyester: 0.5 mm thickness, 150 g/m$^2$ density (Dongguan Huaguan Knitting Co., Ltd).

An assembled precursor construct for the embodiment shown in FIGS. 1 to 3 is prepared by assembling the required layers in the desired order with a sprayed layer of bra cup adhesive being applied between layers and passing the assembled layers through a laminating machine subassembly by subassembly without limitation to any particular order of assembly as long as final assembly comprising a layered assembly of Layer 1—Merino, then Layer 2—microfibre, then Layer 3—foam, then Layer 4—water-repellent polyester, noting layers 3 and 4 can be exchanged if desired as desired above.

The resultant flat (2D) precursor construct composed of the flat laminated fabric is then placed over the male part of a bullet shaped mould of a bra cup moulding machine. The male and female parts of the bra cup machine mould are then engaged together (compression applied) and heated to an optimum moulding temperature of approximately 180° C., for about 170 seconds.

The resultant moulded bra cups are then removed by hand from the machine and are trimmed into the finished bra cup shape along the compressed edges of the cup.

Performance Testing of exemplified moulded bra cup—To compare the fluid capacity advantages provided by the exemplified moulded 3D bra of the invention, the following study was carried out using a bra cup as described in Example 1 above. The moisture management capability of the exemplified moulded assembly of the invention was compared to an equivalent amount of Modifier Technology™ flat (2D) assembly as follows. The Modifier tech assembly was cut into the same shape/area as a standard moulded cup (which corresponds to a 10C-DD cup). The cut fabric assembly was completely soaked in water and then drip dried for 10 seconds. The fabric assembly was then hand squeezed and fluid collected into a bowl and the volume of recovered fluid was measured. This test was repeated by the same tester.

| Test No. | Modifier Technology (fluid vol recovered) | Moulded assembly (fluid vol recovered) |
|---|---|---|
| 1 | 26 | 58 |
| 2 | 26 | 62 |

This demonstrates the desirable moisture management capability of the moulded bra cup of the invention when it includes a foam scaffold component, despite the expectation that such moulded assemblies would not retain moisture management capability after subjection to a stretching and/or compression experienced moulding process.

Appearance after Washing AS20001.5.4: Appearance after washing of the garment (10 washes)—checks for delamination, orange peel effect, creasing, pilling, snagging or any other visual defects. Wash cup in a top-loading agitator, cold gentle machine wash, 8 mins, line dry, 10 cycles. Appearance is then checked visually for colour change, cross staining, pilling/fuzzing/puckering, fabric creases, incompatibility of components, foam cup puckering, dimensional stability (shrinkage), spirality, fraying, pile loss, delamination, any other significant changes. Care instruction given by Modibodi: Cool gentle machine wash, do not bleach/iron/tumble dry. Results: Shade change=Grade 4-5 (really good); Cross Staining=Grade 4-5 (really good); Appearance Change—No change.

Absorbency (modified lab test AATCC 79(MOD))—Wash in a top-loading agitator, cold gentle machine wash, 8 mins, line dry, 3 cycles prior to testing as absorbency is known to increase after initial early washes). Moulded 3D cup is placed so that concave side is top facing. 2.5 ml saline-water solution at a time added and wait 5 mins to check leakage. If not leaking re-apply 2.5 ml until saturation point. Results: 25 ml (note this is smallest cup size for use in cutting to 10C-DD cut size, larger sizes hold more).

Re-Wet Test (Modified QB/R 5049: 2017)—Filter paper is applied to the inner surface and pressure applied. Result is in grams as it is measured as the difference in weight of the filter paper before and after application. This test is to determine how dry the fabric will feel against the skin. Results: 0.3 g of fluid absorbed onto paper indicating very dry wicking component.

Leakage test (check waterproof capability) GB/T 28004 (Modified). Wash in a top-loading agitator, 11B, cold gentle machine wash, 8 mins, line dry, 3 cycles prior to testing. 10 ml saline water solution added to cup inner. Filter paper is applied to the outer surface and pressure applied to determine the solution leakage quantity through the basement membrane. Result is in grams as it is measured as the difference in weight of the filter paper before and after application. 10 ml liquid quantity was determined by Modibodi, as the likely the largest amount of reasonable breast leakage. Result: 0.4 g fluid absorbed onto paper.

The invention claimed is:

1. A launderable bra comprising moisture management thermomoulded 3D bra cups for supporting breasts, wherein each bra cup comprises a thermomoulded 3D breast/bra cup shaped laminated assembly comprising:

a fluid wicking fabric component for wicking bodily fluid from a wearer's skin and having a first face contactable against the wearer's skin during normal use and having a second face;

a fluid trapping core element for protecting the garment from fluid leaks by trapping wicked bodily fluid therein, the fluid trapping core element having a first face that is laminated to the second face of the fluid wicking fabric component, and a moisture barrier fabric component, the moisture barrier fabric component having a first side that is laminated to a second face of the fluid trapping core element, the fluid trapping core element comprising a fluid trapping fabric component and a foam fluid trapping bra cup scaffold component, wherein the first face of the fluid trapping core element is on the fluid trapping fabric component and the second face of the fluid trapping core element is on the foam fluid trapping bra cup scaffold component, wherein the fluid wicking fabric component, the fluid trapping fabric component, the foam fluid trapping bra cup scaffold component, and the moisture barrier fabric component are laminated together by thermomoulding, wherein an outer face of the moisture barrier fabric component faces away from the wearer's breast skin during normal use, wherein each part in the assembly adopts a thermomoulded 3D breast/bra cup shape; and wherein at least one of the fluid wicking fabric component and the moisture barrier fabric component comprises fibres, at least a portion of which are stretched into a more open structure after thermomoulding compared to an equivalent component before thermomoulding.

2. The launderable bra of claim 1, wherein the foam fluid trapping bra cup scaffold component is composed of a fluid trapping material selected from a polyurethane foam, a polyester foam, a biodegradable foam, a recycled foam, a plant based foam, or a foam comprising a proportion of biodegradable material.

3. The launderable bra of claim 1, wherein the fluid trapping core element comprises a fluid trapping bra cup scaffold component comprising a spacer cup material.

4. The launderable bra of claim 1, wherein one or more interlayers between each part of the thermomoulded laminate assembly comprise one or more laminating adhesives provided over entirely all surface areas of each part which contact a surface area of another part, and wherein the one or more laminating adhesives interpenetrate at least a portion of the fibres of one or more parts of the thermomoulded laminate assembly.

5. The launderable bra of claim 1, wherein at least one of the fluid trapping fabric core element, the fluid wicking fabric component, and the moisture barrier fabric component comprise a knitted fabric, a woven fabric, or a non-woven fabric.

6. The launderable bra of claim 1, wherein at least a portion of the thermomoulded laminated assembly is compressed in thickness after thermomoulding compared to an equivalent assembly before thermomoulding.

7. The launderable bra of claim 1, wherein the fluid wicking fabric component, the fluid trapping core element and the moisture barrier component are each laminated together throughout the entirety of each contacting face's surface area.

8. The launderable bra of claim 1, wherein the fluid trapping core element comprises a fluid trapping fabric component comprising at least one layer of an absorbent fabric or the fluid trapping core element comprises an absorbent cellulosic material or fabric.

9. The launderable bra of claim 1, wherein the fluid wicking fabric component is composed of wool; a polyester based fabric or mesh; or a fabric or mesh comprising cellulosic fibres or any combination or organic variation thereof.

10. The launderable bra of claim 1, wherein the moisture barrier component is a fabric treated with at least one waterproof, water resistant, and/or water repellent agent.

11. The launderable bra of claim 1, wherein the fluid wicking fabric component is Merino wool; the fluid trapping core element is a polyester or a polyester polyamide blended microfibre fluid trapping fabric component and a polyurethane foam fluid trapping bra cup scaffold component; and the moisture barrier fabric component is a polyester knit fabric treated with at least one water repellent polymer.

12. The launderable bra of claim 1, wherein the bra is a maternity bra, a singlet bra, a t-shirt bra, or a sports bra.

13. The launderable bra of claim 1, wherein each bra cup sits in a bra cradle, the bra cradle comprising a moisture management flat (2D) construct comprising:

a fluid wicking fabric component for wicking bodily fluid from a wearer's skin in use and having a first face contactable against the wearer's skin in use and a second face laminated to a first face of a fluid trapping core element for protecting the bra from fluid leaks by trapping wicked bodily fluid therein, wherein a second face of the fluid trapping core element is laminated to a first side of a moisture barrier fabric component, wherein the moisture management flat (2D) construct is not moulded.

* * * * *